US006281181B1

(12) United States Patent
Vinson et al.

(10) Patent No.: US 6,281,181 B1
(45) **Date of Patent: *Aug. 28, 2001**

(54) LIGHT-DUTY LIQUID OR GEL DISHWASHING DETERGENT COMPOSITIONS COMPRISING MID-CHAIN BRANCHED SURFACTANTS

(75) Inventors: Phillip Kyle Vinson, Fairfield; Thomas Anthony Cripe, Loveland, both of OH (US); William Michael Scheper; Robert Emerson Stidham, both of Lawrenceburg, IN (US); Daniel Stedman Connor, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/529,558

(22) Filed: Apr. 14, 2000

Related U.S. Application Data

(60) Provisional application No. 60/063,997, filed on Oct. 14, 1997.

(51) Int. Cl.[7] ..... C11D 17/00

(52) U.S. Cl. ..... 510/235; 510/424; 510/426; 510/427

(58) Field of Search ..... 510/503, 235, 510/427, 492, 424, 426

(56) References Cited

U.S. PATENT DOCUMENTS

| | | | |
|---|---|---|---|
| 2,695,327 | 11/1954 | Ziegler et al. | 260/683.15 |
| 2,934,568 | 4/1960 | Baker et al. | 260/615 |
| 3,480,556 | 11/1969 | DeWitt et al. | 252/152 |
| 3,647,906 | 3/1972 | Farley | 260/683 |
| 3,775,349 | 11/1973 | Tuvell et al. | 252/547 |
| 3,887,624 | 6/1975 | Gibson et al. | 260/615 B |
| 4,075,129 | 2/1978 | Murata et al. | 252/527 |
| 4,102,823 | 7/1978 | Matheson | 252/533 |
| 4,111,855 | 9/1978 | Barrat et al. | 252/545 |
| 4,732,707 | 3/1988 | Naik et al. | 252/548 |
| 4,870,038 | 9/1989 | Page et al. | 502/62 |
| 5,026,933 | 6/1991 | Blain et al. | 585/7 |
| 5,030,774 | 7/1991 | Oswald et al. | 568/882 |
| 5,245,072 | 9/1993 | Giacobbe et al. | 560/99 |
| 5,284,989 | 2/1994 | Apelian et al. | 585/533 |
| 5,446,213 | 8/1995 | Sato et al. | 568/883 |
| 5,562,866 | 10/1996 | Hu et al. | 510/432 |
| 5,780,694 | 7/1998 | Singleton | 568/909 |
| 6,008,181 | 12/1999 | Cripe et al. | 510/426 |
| 6,015,781 | 1/2000 | Vinson et al. | 510/302 |
| 6,020,303 | 2/2000 | Cripe et al. | 510/503 |
| 6,046,152 | 4/2000 | Vinson et al. | 510/428 |
| 6,060,443 | 5/2000 | Cripe et al. | 510/426 |

FOREIGN PATENT DOCUMENTS

| | | | |
|---|---|---|---|
| 1086178 | 9/1980 | (CA) | 134/3.11 |
| 2243307 | 9/1972 | (DE) . | |
| 0 232 092 A2 | 8/1987 | (EP) | C11D/3/30 |
| 0342917 | 11/1989 | (EP) . | |
| 0 357 496 | 3/1990 | (EP) . | |
| 0401642 | 12/1990 | (EP) . | |
| 0439316 A2 | 7/1991 | (EP) . | |
| 0 439 316 B1 | 11/1995 | (EP) . | |
| 0684300 | 11/1995 | (EP) . | |
| 0 728 475 A2 | 12/1995 | (EP) . | |
| 0 839 898 A1 | 11/1996 | (EP) . | |
| 0 859 045 A1 | 10/1997 | (EP) . | |
| 1151630 | 2/1958 | (FR) . | |
| 2176794 | 11/1973 | (FR) . | |
| 2267369 | 7/1975 | (FR) . | |
| 2424316 | 11/1979 | (FR) . | |
| 2 486 821 | 7/1981 | (FR) . | |
| 719445 | 12/1954 | (GB) . | |
| 2 303 144 A | 2/1997 | (GB) . | |
| WO 85/02175 | 5/1985 | (WO) . | |
| WO 94/11488 | 5/1994 | (WO) . | |
| WO 95/00117 | 1/1995 | (WO) . | |
| WO 96/18711 | 6/1996 | (WO) . | |
| WO 97/01521 | 1/1997 | (WO) . | |
| WO 97/29084 | 8/1997 | (WO) . | |
| WO 97/38956 | 10/1997 | (WO) . | |
| WO 97/38957 | 10/1997 | (WO) . | |
| WO 97/38972 | 10/1997 | (WO) . | |
| WO 97/39087 | 10/1997 | (WO) . | |
| WO 97/39088 | 10/1997 | (WO) . | |
| WO 97/39089 | 10/1997 | (WO) . | |
| WO 97/39090 | 10/1997 | (WO) . | |
| WO 97/39091 | 10/1997 | (WO) . | |
| WO 96/04358 | 2/1998 | (WO) . | |
| WO 98/11813 | 3/1998 | (WO) . | |
| WO 98/23566 | 6/1998 | (WO) . | |
| WO 98/23712 | 6/1998 | (WO) . | |
| WO 98/28393 | 7/1998 | (WO) | C11D/3/30 |
| WO 98/35553 | 8/1998 | (WO) . | |

OTHER PUBLICATIONS

XP000602370 "Relationships between Dynamic Contact Angle and Dynamic Surface Tension Properties for Linear and Branched Ethoxylate, Ethoxysulfate, and Sulfate Surfactants" Varadaraj et al., May 15, 1991, pp. 403–406.

(List continued on next page.)

*Primary Examiner*—Necholus Ogden
(74) *Attorney, Agent, or Firm*—S. Robert Chuey; Brian M. Bolam; Donald E. Hasse

(57) ABSTRACT

Light-duty liquid or gel dishwashing detergent compositions that are especially useful for manual washing of heavily soiled dishware under conditions of low temperature and high hardness. Such compositions contain a surfactant system comprising a mid-hain branched surfactant. Preferably, the compositions also comprise a polyhydroxy fatty acid amide-based nonionic surfactant component, a detersive amount of magnesium or calcium, a suds booster which is preferably an amine oxide and an aqueous liquid carrier. The detergent compositions exhibit excellent phase stability at low temperatures and excellent mixing rates with water, even at low temperature and/or high water hardness.

20 Claims, No Drawings

OTHER PUBLICATIONS

XP002036586 "Relationship between Fundamental Interfacial Properties and Foaming in Linear and Branched Sulfate, Ethoxysulfate, and Ethoxyalte Surfactants" Varadaraj et al. Apr. 3, 1990, pp. 31–34.

R.G. Laughlin, "The Aqueous Phase Behavior of Surfactants", *Academic Press*, N.Y. (1980), p. 347. *NMA.

Finger, et al., "Detergent Alcohols—the effect of alcohol structure and molecular weight on surfactant properties", *J. Amer. Oil Chemists' Society*, vol. 44, (1967), p. 525. *NMA.

K. R. Wormuth, et al., "Phase Behavior of Branched Surfactants in Oil and Water", *Langmuir*, vol. 7, (1991), pp. 2048–2053. *NMA.

R. Varadaraj, et al., "Fundamental Interfacial Properties of Alkyl–Branched Sulfate and Ethoxy Sulfate Surfactants Derived from Guerbet Alcohols. 1. Surface and Instantaneous Interfacial Tensions", *J. Phys. Chem.*, vol. 95 (1991), pp. 1671–1676.

R. Varadaraj, et al., "Relationship between Fundamental Interfacial Properties and Foaming In Linear and Branched Sulfate, Ethoxysulfate, and Ethoxylate Surfactants", *Journal of Colloid and Interface Science*, vol. 140, No. 1 (Nov. 1990), pp. 31–34.

R. Varadaraj, et al., "Micropolarity and Water Penetration in Micellar Aggregates of Linear and Branched Hydrocarbon Surfactants", *Langmuir*, vol. 6 (1990), pp. 1376–1378. *NMA.

R. Varadaraj, et al., "Relationship between Dynamic Contact Angle and Dynamic Surface Tension Properties for Linear and Branched Ethoxylate, Ethoxysulfate, and Sulfate Surfactants", *Journal of Colloid and Interface Science*, vol. 147, No. 2 (Dec. 1991), pp. 403–406.

R. D. Swisher, "Surfactant Biodegradation", *Surfactant Science Series*, $2^{nd}$ Ed., Marcel Dekker, Inc., vol. 18, pp. 20–29 and 34–36. *NMA CEH Marketing Research Report "Detergent Alcohols" by R. F. Modler, et al., *Chemical Economics Handbook*, (1993), pp. 609.5000—609.5002. *NMA.

"Alcohols, Higher Aliphatic", *Kirk Othmer's Encyclopedia of Chemical Technology*, $4^{th}$ Ed., Wiley, N.Y., (1991), vol. 1, pp. 865–913. *NMA.

"Liquid Fuels", *Kirk Othmer's Encyclopedia of Chemical Technology*, Wiley, N.Y., (1989), vol. 11, pp. 447–489. *NMA.

"Oxo Process", *Kirk Othmer's Encyclopedia of Chemical Technology*, Wiley, N.Y., (1989), vol. 16, pp. 637–653. *NMA.

"Sasol Detergent Alcohols", R&D Technical Bulletin, Sasol Alpha Olefins, (Oct. 1, 1996), pp. 1–12.

LIGHT-DUTY LIQUID OR GEL DISHWASHING DETERGENT COMPOSITIONS COMPRISING MID-CHAIN BRANCHED SURFACTANTS

This application claims benefit to Provisional Application 60/063,997 filed Oct. 14, 1997.

TECHNICAL FIELD

The present invention relates to liquid or gel dishwashing detergent compositions suitable for use in manual dishwashing operations. These liquid detergent compositions contain a surfactant system which comprises mid-chain branched surfactants. Additionally, these compositions optionally comprise other surfactants, suds boosters, viscosity control agents and other adjuvants which in combination serve to impart consumer preferred food soil cleaning and sudsing characteristics to such dishwashing detergent products.

BACKGROUND OF THE INVENTION

Light-duty liquid (LDL) or gel detergent compositions useful for manual dishwashing are well known in the art. Such products are generally formulated to provide a number of widely diverse performance and aesthetics properties and characteristics. First and foremost, liquid or gel dishwashing products must be formulated with types and amounts of surfactants and other cleaning adjuvants that will provide acceptable solubilization and removal of food soils, especially greasy soils, from dishware being cleaned with, or in aqueous solutions formed from, such products.

Heavily soiled dishware can present special problems during manual dishwashing operations. Articles such as plates, utensils, pots, pans, crockery and the like may be heavily soiled in the sense that relatively large amounts of food soils and residues may still be found on the dishware at the time such soiled dishware is to be manually washed. Dishware may also be heavily soiled in the sense that food soil residues are especially tenaciously adhered or stuck to the surfaces of the dishware to be cleaned. This can result from the type of food soils present or from the nature of the dishware surfaces involved. Tenacious food soil residues may also result from the type of cooking operations to which the soiled dishware had been subjected. To clean such dishware an appropriate surfactant combination must be employed.

In addition to being suitable for cleaning dishware, LDL or gel compositions will also desirably possess other attributes that enhance the aesthetics or consumer perception of the effectiveness of the manual dishwashing operation. Thus, useful hand dishwashing liquids or gels should also employ materials that enhance the sudsing characteristics of the wash solutions formed from such products. Sudsing performance entails both the production of a suitable amount of suds in the wash water initially, as well as the formation of suds which last well into the dishwashing process.

Hand dishwashing liquids or gels should also employ materials that enhance product phase stability at low temperatures. Lack of phase stability can lead to unacceptable theological and aesthetic properties as well as to performance issues. Such low temperatures can be encountered in warehouses, in the consumer's garage, in the consumer's automobile, during street vending, on the kitchen window sill, and the like. Further, hand dishwashing liquids and gels should employ materials that enhance the dissolution, or rate of product mixing, with water. Further, hand dishwashing liquids and gels should employ materials that enhance the tolerance of the system to hardness, especially to avoid the precipitation of the calcium salts of anionic surfactants. Precipitation of the calcium salts of anionic surfactants is known to cause suppression of suds and irritation to the skin.

Given the foregoing, there is a continuing need to formulate manual dishwashing liquids and gels that provide an acceptable and desirable balance between cleaning performance and product aesthetics. Accordingly, it is an object of the present invention to provide light-duty liquid or gel dishwashing compositions which are especially effective at removing food soils from dirty dishware when such compositions are used in the context of a manual dishwashing operation.

It has further been found, that the mid-chain branched surfactants provide significantly improved tolerance to hardness, significantly improved low temperature stability of the finished product and significantly improved rates of mixing of the product with water.

It is a further object of this invention to provide such compositions having desirable rheological characteristics for use in either a direct application to dishware context or in an aqueous dishwashing solution context.

It is a further object of the present invention to realize such compositions that provide suitable and desirable sudsing performance.

It has been found that certain selected surfactant systems which comprise the mid-chain branched surfactants defined below, suds boosters, viscosity control agents and other adjuvants can be made to provide dishwashing compositions that achieve the foregoing objectives. The elements of these selected combinations of ingredients are described as follows:

SUMMARY OF THE INVENTION

The present invention relates to aqueous light-duty liquid or gel detergent compositions having especially desirable soil removal and sudsing performance when such compositions are used to clean heavily soiled dishware. Such compositions comprise up to 70%, by weight of a surfactant system comprising a branched surfactant mixture which comprises mid-chain branched and linear surfactant compounds.

The surfactant system comprises at least about 10%, preferably at least about 20%, more preferably at least about 30%, most preferably at least about 50%, by weight of a branched surfactant mixture, said branched surfactant mixture comprising mid-chain branched and linear surfactant compounds, said linear compounds comprising less than 25%, preferably less than about 15%, more preferably less than about 10% and most preferably less than about 5%, by weight of the branched surfactant mixture and the mid-chain branched compounds have the formula:

$$A^b\text{–}B.$$

Wherein $A^b$ is a hydrophobic C9 to C18, total carbons in the moiety, preferably from about C10 to about C15, mid-chain branched alkyl moiety having: (1) a longest linear carbon chain attached to the—B moiety in the range of from 8 to 17 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 3 carbon, counting from carbon #1 which is attached to the—B moiety, to position ω–2 carbon, the terminal carbon minus 2 carbons; and (4) the surfactant composition has an average total number of carbon atoms in the $A^b$ moiety in the above formula within the range of greater than 12 to about 14.5.

B is a hydrophilic moiety selected from the group consisting of $OSO_3M$, $(EO/PO)mOSO_3M$, (EO/PO)mOH and mixtures thereof. EO/PO are alkoxy moieties selected from the group consisting of ethoxy, propoxy, and mixtures thereof, and m is at least about 0.01 to about 30. The average total number of carbon atoms in the $A^b$ moiety in the branched surfactant mixture defined above should be within the range of greater than about 12 to about 14.5, preferably greater than about 12 to about 14 and most preferably greater than about 12 to about 13.5.

The surfactant system of the liquid detergent compositions of the present invention can optionally comprise additional surfactants such as anionics and nonionics. If present, the anionic surfactant component essentially comprises alkyl ether sulfates containing from about 9 to 18 carbon atoms in the alkyl group. These alkyl ether sulfates also contain from about 1 to 12 moles of ethylene oxide per molecule. If present, the nonionic surfactant component essentially comprises $C_8$–$C_{18}$ polyhydroxy fatty acids amides. In the nonionic surfactant components such polyhydroxy fatty acids amides may also be combined with from about 0.2% to 2% of the composition of a nonionic co-surfactant. This nonionic co-surfactant is selected from $C_8$–$C_{18}$ alcohol ethoxylates having from about 1 to 30 moles of ethylene oxide, ethylene oxide-propylene oxide block co-polymer surfactants and combinations of these nonionic co-surfactants.

The compositions of the present invention can also optionally comprise a suds booster/stabilizer selected from betaine surfactants, alkanol fatty acid amides, amine oxide semipolar nonionic surfactants and $C_8$–$C_{22}$ alkylpolyglycosides. Combinations of these suds booster/stabilizers may also be utilized.

The compositions of the present invention can also optionally comprise a buffering agent selected from organic diamines and alkanolamines. Combinations of these diamines and alkanolamines may also be utilized.

The foregoing essential components, as well a number of additional optional ingredients, can be combined in conventional manner to form the light-duty liquid or gel dishwashing detergent products of this invention.

DETAILED DESCRIPTION OF THE INVENTION

The light-duty liquid or gel dishwashing detergent compositions of the present invention contain a surfactant system which comprises certain mid-chain branched alkyl surfactants and certain nonionic surfactants and an aqueous liquid carrier. A wide variety of optional ingredients can also be added to compliment the performance, rheological and/or aesthetics characteristics of the compositions herein.

The essential and optional components of the instant light duty liquid or gel dishwashing detergents are described in detail as follows, along with composition preparation and use. In describing the compositions of the present invention, it should be noted that the term "light-duty dishwashing detergent composition" as used herein refers to those compositions which are employed in manual (i.e. hand) dishwashing. Such compositions are generally high sudsing or foaming in nature. In describing the compositions of this invention, it should also be noted that all concentrations and ratios are on a weight basis unless otherwise specified.

Branched Surfactant Mixture

The surfactant system of the subject liquid detergent compositions comprises at least about 10%, preferably at least about 20%, more preferably at least about 30%, most preferably at least about 50%, by weight of a branched surfactant mixture, said branched surfactant mixture comprising mid-chain branched and linear surfactant compounds, said linear compounds comprising less than 25%, preferably less than about 15%, more preferably less than about 10% and most preferably less than about 5%, by weight of the branched surfactant mixture and said mid-chain branched compounds being of the formula:

$$A^b\text{–}B$$

wherein:

$A^b$ is a hydrophobic C9 to C18, total carbons in the moiety, preferably from about C10 to about C15, mid-chain branched alkyl moiety having: (1) a longest linear carbon chain attached to the—B moiety in the range of from 8 to 17 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 3 carbon, counting from carbon #1 which is attached to the—B moiety, to position ω−2 carbon, the terminal carbon minus 2 carbons; and (4) the surfactant composition has an average total number of carbon atoms in the $A^b$ moiety in the above formula within the range of greater than 12 to about 14.5; and B is a hydrophilic moiety selected from the group consisting of $OSO_3M$, $(EO/PO)mOSO_3M$, (EO/PO)mOH and mixtures thereof. EO/PO are alkoxy moieties selected from the group consisting of ethoxy, propoxy, and mixtures thereof, and m is at least about 0.01 to about 30. The average total number of carbon atoms in the $A^b$ moiety in the branched surfactant mixture defined above should be within the range of greater than 12 to about 14.5, preferably greater than about 12 to about 14 and most preferably greater than about 12 to about 13.5. The "total" number of carbon atoms as used herein is intended to mean the number of carbon atoms in the longest chain, i.e. the backbone of the molecule, plus the number of carbon atoms in all of the short chains, i.e. the branches.

The $A^b$ moiety of the mid-chain branched surfactant components of the present claims is preferably a branched alkyl moiety having the formula:

$$CH_3CH_2(CH_2)_wCH(R)(CH_2)_xCH(R^1)(CH_2)_yCH(R^2)(CH_2)_zCH_2.$$

Wherein the total number of carbon atoms in the branched alkyl moiety, including the R, $R^1$, and $R^2$ branching, is from 10 to 17. R, $R^1$, and $R^2$ are each independently selected from hydrogen and $C_1$–$C_3$ alkyl, preferably methyl, provided that R, $R^1$, and $R^2$ are not all hydrogen. Additionally, when z is 0, at least R or $R^1$ is not hydrogen. Moreover, w is an integer from 0 to 10; x is an integer from 0 to 10; y is an integer from 0 to 10; z is an integer from 0 to 10; and w+x+y+z is from 3 to 10.

In another preferred embodiment of the present claims, the $A^b$ moiety of the mid-chain branched surfactant component is a branched alkyl moiety having the formula selected from the group consisting of:

(I)

$$CH_3(CH_2)_aCH(CH_3)(CH_2)_bCH_2-,$$

(II)

$$CH_3(CH_2)_dCH(CH_3)(CH_2)_eCH(CH_3)CH_2-,$$

and mixtures thereof.

Wherein a, b, d, and e are integers, and a+b is from 6 to 13, d+e is from 4 to 11. Further, when a+b=6, a is an integer from 2 to 5 and b is an integer from 1 to 4;

when a+b=7, a is an integer from 2 to 6 and b is an integer from 1 to 5;

when a+b=8, a is an integer from 2 to 7 and b is an integer from 1 to 6;

when a+b=9, a is an integer from 2 to 8 and b is an integer from 1 to 7;

when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when d+e=4, d is an integer from 2 to 3 and e is an integer from 1 to 2;

when d+e=5, d is an integer from 2 to 4 and e is an integer from 1 to 3;

when d+e=6, d is an integer from 2 to 5 and e is an integer from 1 to 4;

when d+e=7, d is an integer from 2 to 6 and e is an integer from 1 to 5;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9.

Mid-chain Branched Primary Alkyl Sulfate Surfactants

The mid-chain branched surfactant compositions of the present invention may comprise one or more mid-chain branched primary alkyl sulfate surfactants having the formula:

$$CH_3CH_2(CH_2)_wCH(R)(CH_2)_xCH(R^1)(CH_2)_yCH(R^2)(CH_2)_zCH_2OSO_3M.$$

More specifically, the branched surfactant mixtures of the present invention comprise molecules having a linear primary alkyl sulfate chain backbone (i.e., the longest linear carbon chain which includes the sulfated carbon atom). These alkyl chain backbones comprise from about 9 to about 18 carbon atoms; and further the molecules comprise a branched primary alkyl moiety or moieties having at least about 1, but not more than 3, carbon atoms. In addition, the surfactant mixture has an average total number of carbon atoms for the branched primary alkyl moieties of less than about 14.5, preferably within the range of from about 12 to about 14.5. Thus, the present invention mixtures comprise at least one branched primary alkyl sulfate surfactant compound having a longest linear carbon chain of not less than 8 carbon atoms or more than 17 carbon atoms, and the average total number of carbon atoms for the branched primary alkyl chains is within the range of greater than 12 to about 14.5, preferably greater than about 12 to about 14 and most preferably greater than about 12 to about 13.5.

For example, a C14 total carbon primary alkyl sulfate surfactant having 11 carbon atoms in the backbone must have 1, 2, or 3 branching units (i.e., R, $R^1$ and/or $R^2$) whereby total number of carbon atoms in the molecule is 14. In this example, the C14 total carbon requirement may be satisfied equally by having, for example, one propyl branching unit or three methyl branching units.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 0, at least R or $R^1$ is not hydrogen.

Although for the purposes of the present invention surfactant compositions the above formula does not include molecules wherein the units R, $R^1$, and $R^2$ are all hydrogen (i.e., linear non-branched primary alkyl sulfates), it is to be recognized that the present invention compositions may still further comprise some amount of linear, non-branched primary alkyl sulfate. Further, this linear non-branched primary alkyl sulfate surfactant may be present as the result of the process used to manufacture the surfactant mixture having the requisite one or more mid-chain branched primary alkyl sulfates according to the present invention, or for purposes of formulating detergent compositions some amount of linear non-branched primary alkyl sulfate may be admixed into the final product formulation.

Further it is to be similarly recognized that non-sulfated mid-chain branched alcohol may comprise some amount of the present invention compositions. Such materials may be present as the result of incomplete sulfation of the alcohol used to prepare the alkyl sulfate surfactant, or these alcohols may be separately added to the present invention detergent compositions along with a mid-chain branched alkyl sulfate surfactant according to the present invention.

M is hydrogen or a salt forming cation depending upon the method of synthesis. Examples of salt forming cations are lithium, sodium, potassium, calcium, magnesium, quaternary alkyl amines having the formula $$R^6-N^+(R^3)(R^5)-R^4$$

wherein $R^3$, $R^4$, $R^5$ and $R^6$ are independently hydrogen, $C_1$–$C_{22}$ alkylene, $C_4$–$C_{22}$ branched alkylene, $C_1$–$C_6$ alkanol, $C_1$–$C_{22}$ alkenylene, $C_4$–$C_{22}$ branched alkenylene, and mixtures thereof. Preferred cations are ammonium ($R^3$, $R^4$, $R^5$ and $R^6$ equal hydrogen), sodium, potassium, mono-, di-, and trialkanol ammonium, and mixtures thereof. The monoalkanol ammonium compounds of the present invention have $R^3$ equal to $C_1$–$C_6$ alkanol, $R^4$, $R^5$ and $R^6$ equal to hydrogen; dialkanol ammonium compounds of the present invention have $R^3$ and $R^4$ equal to $C_1$–$C_6$ alkanol, $R^5$ and $R^6$ equal to hydrogen; trialkanol ammonium compounds of the present invention have $R^3$. $R^4$ and $R^5$ equal to $C_1$–$C_6$ alkanol, $R^6$ equal to hydrogen. Preferred alkanol ammonium salts of the present invention are the mono-, di-, and tri-quaternary ammonium compounds having the formulas: $H_3N^+CH_2CH_2OH$, $H_2N^+(CH_2CH_2OH)_2$, $HN^+(CH_2CH_2OH)_3$.

Preferred M is sodium, potassium and the $C_2$ alkanol ammonium salts listed above; the most M preferred is sodium.

Further regarding the above formula, w is an integer from 0 to 10; x is an integer from 0 to 10; y is an integer from 0 to 10; z is an integer from 0 to 10; and w+x+y+z is an integer from 2 to 11.

The preferred surfactant mixtures of the present invention have at least about 10%, more preferably at least about 20%, even more preferably at least about 30% and most preferably at least about 50% by weight, of the mixture of one or more branched primary alkyl sulfates having the formula:

$$CH_3CH_2(CH_2)_x\overset{\overset{R^1}{|}}{C}H(CH_2)_y\overset{\overset{R^2}{|}}{C}H(CH_2)_zCH_2OSO_3M.$$

Wherein the total number of carbon atoms, including branching, is from 10 to 16, and the average total number of carbon atoms in the branched primary alkyl moieties having the above formula is within the range of greater than 12 to about 14. $R^1$ and $R^2$ are each independently hydrogen or $C_1$–$C_3$ alkyl. M is a water soluble cation, and x is from 0 to 10, y is from 0 to 10, z is from 0 to 10 and x+y+z is from 4 to 10. Further, $R^1$ and $R^2$ are not both hydrogen. More preferred are compositions having at least 5% of the mixture comprising one or more mid-chain branched primary alkyl sulfates wherein x+y is equal to 6 and z is at least 1.

Preferably, the mixtures of surfactant comprise at least 5% of a mid chain branched primary alkyl sulfate having $R^1$ and $R^2$ independently hydrogen or methyl, provided $R^1$ and $R^2$ are not both hydrogen. It is further provided that x+y is equal to 5, 6 or 7 and z is at least 1. More preferably the mixtures of surfactant comprise at least 20% of a mid chain branched primary alkyl sulfate having $R^1$ and $R^2$ independently hydrogen or methyl, provided $R^1$ and $R^2$ are not both hydrogen, and x+y is equal to 5, 6 or7andzisatleast 1.

Preferred mid-chain branched primary alkyl sulfate surfactants for use in the detergent compositions defined herein are selected from the group of compounds having (I)

$$CH_3(CH_2)_a\overset{\overset{CH_3}{|}}{C}H(CH_2)_bCH_2OSO_3M,$$

(II)

$$CH_3(CH_2)_d\overset{\overset{CH_3}{|}}{C}H(CH_2)_e\overset{\overset{CH_3}{|}}{C}HCH_2OSO_3M,$$

and mixtures thereof.

Wherein a, b, d, and e are integers, and a+b is from 6 to 13, d+e is from 4 to 11. Further, when a+b 6, a is an integer from 2 to 5 and b is an integer from 1 to 4;

when a+b=7, a is an integer from 2 to 6 and b is an integer from 1 to 5;

when a+b=8, a is an integer from 2 to 7 and b is an integer from 1 to 6;

when a+b 9, a is an integer from 2 to 8 and b is an integer from 1 to 7;

when a+b=10, a is an integer from 2 to 9 and b is an integer from 1 to 8;

when a+b=1, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when d+e=4, d is an integer from 2 to 3 and e is an integer from 1 to 2;

when d+e=5, d is an integer from 2 to 4 and e is an integer from 1 to 3;

when d+e=6, d is an integer from 2 to 5 and e is an integer from 1 to 4;

when d+e=7, d is an integer from 2 to 6 and e is an integer from 1 to 5;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9.

Wherein the average total number of carbon atoms in the branched primary alkyl moieties having the above formulas is within the range of greater than about 12 to about 14.5.

Especially preferred mid-chain branched surfactants are those comprising a mixture of compounds having the general formulas from Groups I and II, wherein the molar ratio of compounds according to Group I to Group II is greater than 4:1, preferably greater than 9:1 and most preferably greater than 20:1.

Further, the present invention surfactant composition may comprise a mixture of linear and branched surfactants wherein the branched primary alkyl sulfates have the formula:

$$CH_3CH_2(CH_2)_w\overset{\overset{R}{|}}{C}H(CH_2)_x\overset{\overset{R^1}{|}}{C}H(CH_2)_y\overset{\overset{R^2}{|}}{C}H(CH_2)_zCH_2OSO_3M.$$

Wherein the total number of carbon atoms per molecule, including branching, is from 10 to 17, and the average total number of carbon atoms in the branched primary alkyl moieties having the above formula is within the range of greater than about 12 to about 14.5. R, $R^1$, and $R^2$ are each independently selected from hydrogen and $C_1$–$C_3$ alkyl, provided R, $R^1$, and $R^2$ are not all hydrogen. M is a water soluble cation, and w is an integer from 0 to 10, x is an integer from 0 to 10, y is an integer from 0 to 10, z is an integer from 0 to 10 and w+x+y+z is from 3 to 10. Provided that when $R^2$ is a $C_1$–$C_3$ alkyl the ratio of surfactants having z equal to 0 to surfactants having z of 1 or greater is at least about 1:1, preferably at least about 1:5, more preferably at least about 1:10, and most preferably at least about 1:20. Also preferred are surfactant compositions, when $R^2$ is a $C_1$–$C_3$ alkyl, comprising less than about 20%, preferably less than 10%, more preferably less than 5%, most preferably less than 1%, of branched primary alkyl sulfates having the above formula wherein z equals 0.

Preferred mono-methyl branched primary alkyl sulfates are selected from the group consisting of: 3-methyl dodecanol sulfate, 4-methyl dodecanol sulfate, 5-methyl dodecanol sulfate, 6-methyl dodecanol sulfate, 7-methyl dodecanol sulfate, 8-methyl dodecanol sulfate, 9-methyl dodecanol sulfate, 10-methyl dodecanol sulfate, 3-methyl tridecanol sulfate, 4-methyl tridecanol sulfate, 5-methyl tridecanol sulfate, 6-methyl tridecanol sulfate, 7-methyl tridecanol sulfate, 8-methyl tridecanol sulfate, 9-methyl tridecanol sulfate, 10-methyl tridecanol sulfate, 11-methyl tridecanol sulfate, and mixtures thereof.

The following branched primary alkyl sulfates comprising 13 carbon atoms and having one branching unit are examples of preferred branched surfactants useful in the present invention compositions:

5-methyldodecylsulfate having the formula:

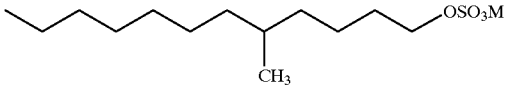

6-methyldodecylsulfate having the formula

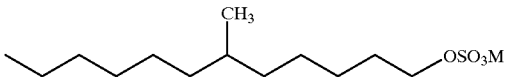

7-methyldodecylsulfate having the formula

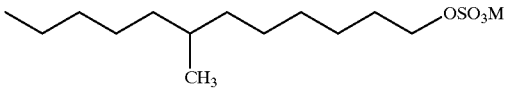

8-methyldodecylsulfate having the formula

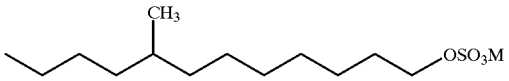

9-methyldodecylsulfate having the formula

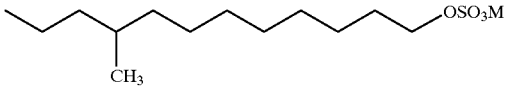

10-methyldodecylsulfate having the formula

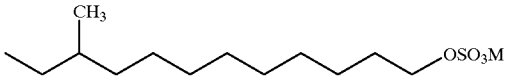

wherein M is preferably sodium.

Preferred di-methyl branched primary alkyl sulfates are selected from the group consisting of: 2,3-dimethyl undecanol sulfate, 2,4-dimethyl undecanol sulfate, 2,5-dimethyl undecanol sulfate, 2,6-dimethyl undecanol sulfate, 2,7-dimethyl undecanol sulfate, 2,8-dimethyl undecanol sulfate, 2,9-dimethyl undecanol sulfate, 2,3-dimethyl dodecanol sulfate, 2,4-dimethyl dodecanol sulfate, 2,5-dimethyl dodecanol sulfate, 2,6-dimethyl dodecanol sulfate, 2,7-dimethyl dodecanol sulfate, 2,8-dimethyl dodecanol sulfate, 2,9-dimethyl dodecanol sulfate, 2,10-dimethyl dodecanol sulfate, and mixtures thereof.

The following branched primary alkyl sulfates comprising 14 carbon atoms and having two branching units are examples of preferred branched surfactants according to the present invention:

2,5-dimethyldodecylsulfate having the formula:

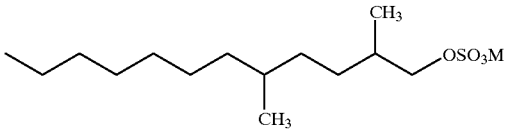

2,6-dimethyldodecylsulfate having the formula

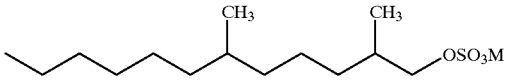

2,7-dimethyldodecylsulfate having the formula

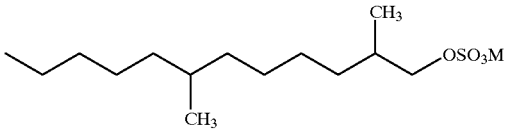

-continued 2,8-dimethyldodecylsulfate having the formula

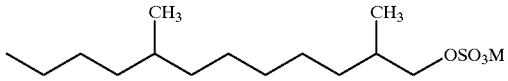

2,9-dimethyldodecylsulfate having the formula

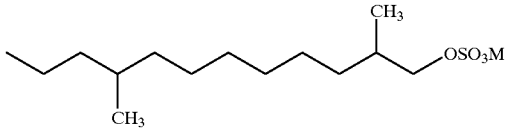

2,10-dimethyldodecylsulfate having the formula

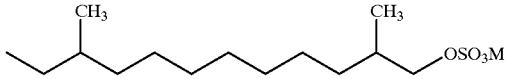

Mid-chain Branched Primary Alkyl Alkoxylated Sulfate Surfactants

The mid-chain branched surfactant components of the present invention may comprise one or more (preferably a mixture of two or more) mid-chain branched primary alkyl alkoxylated sulfates having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zCH_2(EO/PO)mOSO_3M$$

Tne surfactant mixtures of the present invention comprise molecules having a linear primary alkoxylated sulfate chain backbone (i.e., the longest linear carbon chain which includes the alkoxy-sulfated carbon atom). These alkyl chain backbones comprise from about 9 to about 18 carbon atoms; and further the molecules comprise a branched primary alkyl moiety or moieties having at least about 1, but not more than 3, carbon atoms. In addition, the surfactant mixture has an average total number of carbon atoms for the branched primary alkyl moieties of less than about 14.5, preferably within the range of from about 12 to about 14.5. Thus, the present invention mixtures comprise at least one branched primary alkyl sulfate surfactant compound having a longest linear carbon chain of not less than 9 carbon atoms or more than 17 carbon atoms, and the average total number of carbon atoms for the branched primary alkyl chains is within the range of greater than 12 to about 14.5, preferably greater than about 12 to about 14 and most preferably greater than about 12 to about 13.5.

For example, a C14 total carbon primary alkyl sulfate surfactant having 11 carbon atoms in the backbone must have 1, 2, or 3 branching units (i.e., R, $R^1$ and/or $R^2$) whereby total number of carbon atoms in the molecule is 14. In this example, the C14 total carbon requirement may be satisfied equally by having, for example, one propyl branching unit or three methyl branching units.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 0, at least R or $R^1$ is not hydrogen.

Although for the purposes of the present invention surfactant components according to the above formula do not include molecules wherein the units R, $R^1$, and $R^2$ are all hydrogen (i.e., linear non-branched primary alkoxylated sulfates), it is to be recognized that the present invention compositions may still further comprise some amount of linear, non-branched primary alkoxylated sulfate. Further, this linear non-branched primary alkoxylated sulfate surfactant may be present as the result of the process used to manufacture the surfactant mixture having the requisite mid-chain branched primary alkoxylated sulfates according to the present invention, or for purposes of formulating detergent compositions some amount of linear non-branched primary alkoxylated sulfate may be admixed into the final product formulation.

It is also to be recognized that some amount of mid-chain branched alkyl sulfate may be present in the compositions. This is typically the result of sulfation of non-alkoxylated alcohol remaining following incomplete alkoxylation of the mid-chain branched alcohol used to prepare the alkoxylated sulfate useful herein. It is to be recognized, however, that separate addition of such mid-chain branched alkyl sulfates is also contemplated by the present invention compositions.

Further it is to be similarly recognized that non-sulfated mid-chain branched alcohol (including polyoxyalkylene alcohols) may comprise some amount of the present invention alkoxylated sulfate-containing compositions. Such materials may be present as the result of incomplete sulfation of the alcohol (alkoxylated or non-alkoxylated) used to prepare the alkoxylated sulfate surfactant, or these alcohols may be separately added to the present invention detergent compositions along with a mid-chain branched alkoxylated sulfate surfactant according to the present invention.

M is as described hereinbefore.

Further regarding the above formula, w is an integer from 0 to 10; x is an integer from 0 to 10; y is an integer from 0 to 10; z is an integer from 0 to 10; and w+x+y+z is an integer from 2 to 11.

EO/PO are alkoxy moieties, preferably selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5. The $(EO/PO)_m$ moiety may be either a distribution with average degree of alkoxylation (e.g., ethoxylation and/or propoxylation) corresponding to m, or it may be a single specific chain with alkoxylation (e.g., ethoxylation and/or propoxylation) of exactly the number of units corresponding to m.

The preferred surfactant mixtures of the present invention have at least about 10%, more preferably at least about 20%, even more preferably at least about 30% and most preferably at least about 50%, by weight, of the mixture of one or more mid-chain branched primary alkyl alkoxylated sulfates having the formula:

$$CH_3CH_2(CH_2)_xCH(R^1)(CH_2)_yCH(R^2)(CH_2)_zCH_2(EO/PO)mOSO_3M$$

Wherein the total number of carbon atoms, including branching, is from 10 to 16, and the average total number of carbon atoms in the branched primary alkyl moieties having the above formula is within the range of greater than 12 to about 14. $R^1$ and $R^2$ are each independently hydrogen or $C_1$–$C_3$ alkyl; M is a water soluble cation; x is from 0 to 10; y is from 0 to 10; z is from 0 to 10 and x+y+z is from 4 to 10. Further, $R^1$ and $R^2$ are not both hydrogen and EO/PO are alkoxy moieties selected from ethoxy, propoxy, and mixed ethoxy/propoxy groups. Wherein m is at least about 0.01, preferably within the range of from about 0.1 to about 30, more preferably from about 0.5 to about 10, and most preferably from about 1 to about 5. More preferred are compositions having at least 5% of the mixture comprising one or more mid-chain branched primary alkyl alkoxy sulfates wherein x+y is equal to 6 and z is at least 1.

Preferably, the mixtures of surfactant comprise at least 5% of a mid chain branched primary alkyl sulfate having $R^1$ and $R^2$ independently hydrogen or methyl, provided $R^1$ and $R^2$ are not both hydrogen. Additionally, x+y is equal to 5, 6 or 7 and z is at least 1. More preferably the mixtures of surfactant comprise at least 20% of a mid chain branched primary alkyl sulfate having $R^1$ and $R^2$ independently hydrogen or methyl, provided $R^1$ and $R^2$ are not both hydrogen and with x+y equal to 5, 6 or 7 and z is at least 1.

Preferred mixtures of mid-chain branched primary alkyl alkoxylated sulfate and linear alkyl alkoxylated sulfate surfactants comprise at least about 5% by weight of one or more mid-chain branched alkyl alkoxylated sulfates having the formula:

$$CH_3(CH_2)_aCH(CH_3)(CH_2)_bCH_2(EO/PO)mOSO_3M, \quad (I)$$

$$CH_3(CH_2)_dCH(CH_3)(CH_2)_eCHCH_3CH_2(EO/PO)mOSO_3M, \quad (II)$$

and mixtures thereof. Wherein a, b, d, and e are integers, and a+b is from 6 to 13, d+e is from 4 to 11. Further, when a+b=6, a is an integer from 2 to 5 and b is an integer from 1 to 4;

when a+b=7, a is an integer from 2 to 6 and b is an integer from 1 to 5;

when a+b=8, a is an integer from 2 to 7 and b is an integer from 1 to 6;

when a+b=9, a is an integer from 2 to 8 and b is an integer from 1 to 7;

when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when d+e=4, d is an integer from 2 to 3 and e is an integer from 1 to 2;

when d+e=5, d is an integer from 2 to 4 and e is an integer from 1 to 3;

when d+e=6, d is an integer from 2 to 5 and e is an integer from 1 to 4;

when d+e=7, d is an integer from 2 to 6 and e is an integer from 1 to 5;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9.

The average total number of carbon atoms in the branched primary alkyl moieties having the above formulas is within the range of greater than about 12 to about 14.5 and EO/PO are alkoxy moieties selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5.

Especially preferred mid-chain branched surfactants are those comprising a mixture of compounds having the general formulas from Groups I and II, wherein the molar ratio of compounds according to Group I to Group II is greater than 4:1, preferably greater than 9:1 and most preferably greater than 20:1.

Further, the present invention surfactant composition may comprise a mixture of linear and branched surfactants wherein the branched primary alkyl alkoxylated sulfates has the formula:

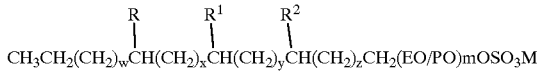

Wherein the total number of carbon atoms per molecule, including branching, is from 10 to 17, and the average total number of carbon atoms in the branched primary alkyl moieties having the above formula is within the range of greater than about 12 to about 14.5. R, $R^1$, and $R^2$ are each independently selected from hydrogen and $C_1$–$C_3$ alkyl, provided R, $R^1$, and $R^2$ are not all hydrogen. M is a water soluble cation and w is an integer from 0 to 10; x is an integer from 0 to 10; y is an integer from 0 to 10; z is an integer from 0 to 10; and w+x+y+z is from 3 to 10. EO/PO are alkoxy moieties, preferably selected from ethoxy, propoxy, and mixed ethoxy/propoxy groups, wherein m is at least about 0.01, preferably within the range of from about 0.1 to about 30, more preferably from about 0.5 to about 10, and most preferably from about 1 to about 5. When $R^2$ is a $C_1$–$C_3$ alkyl the ratio of surfactants having z equal to 0 to surfactants having z of 1 or greater is at least about 1:1, preferably at least about 1:5, more preferably at least about 1:10, and most preferably at least about 1:20. Also preferred are surfactant compositions, when $R^2$ is a $C_1$–$C_3$ alkyl, comprising less than about 20%, preferably less than 10%, more preferably less than 5%, most preferably less than 1%, of branched primary alkyl alkoxylated sulfate having the above formula wherein z equals 0.

Preferred mono-methyl branched primary alkyl ethoxylated sulfates are selected from the group consisting of: 3-methyl dodecanol ethoxylated sulfate, 4-methyl dodecanol ethoxylated sulfate, 5-methyl dodecanol ethoxylated sulfate, 6-methyl dodecanol ethoxylated sulfate, 7-methyl dodecanol ethoxylated sulfate, 8-methyl dodecanol ethoxylated sulfate, 9-methyl dodecanol ethoxylated sulfate, 10-methyl dodecanol ethoxylated sulfate, 3-methyl tridecanol ethoxylated sulfate, 4-methyl tridecanol ethoxylated sulfate, 5-methyl tridecanol ethoxylated sulfate, 6-methyl tridecanol ethoxylated sulfate, 7-methyl tridecanol ethoxylated sulfate, 8-methyl tridecanol ethoxylated sulfate, 9-methyl tridecanol ethoxylated sulfate, 10-methyl tridecanol ethoxylated sulfate, 11-methyl tridecanol ethoxylated sulfate, and mixtures thereof, wherein the compounds are ethoxylated with an average degree of ethoxylation of from about 0.1 to about 10.

Preferred di-methyl branched primary alkyl ethoxylated sulfates selected from the group consisting of: 2,3-dimethyl undecanol ethoxylated sulfate, 2,4-dimethyl undecanol ethoxylated sulfate, 2,5-dimethyl undecanol ethoxylated sulfate, 2,6-dimethyl undecanol ethoxylated sulfate, 2,7-dimethyl undecanol ethoxylated sulfate, 2,8-dimethyl undecanol ethoxylated sulfate, 2,9-dimethyl undecanol ethoxylated sulfate, 2,3-dimethyl dodecanol ethoxylated sulfate, 2,4-dimethyl dodecanol ethoxylated sulfate, 2,5-dimethyl dodecanol ethoxylated sulfate, 2,6-dimethyl dodecanol ethoxylated sulfate, 2,7-dimethyl dodecanol ethoxylated sulfate, 2,8-dimethyl dodecanol ethoxylated sulfate, 2,9-dimethyl dodecanol ethoxylated sulfate, 2,10-dimethyl dodecanol ethoxylated sulfate, and mixtures thereof, wherein the compounds are ethoxylated with an average degree of ethoxylation of from about 0. 1 to about 10.

Mid-chain Branched Primary Alkyl Polyoxyalkylene Surfactants

The present invention branched surfactant compositions may comprise one or more mid-chain branched primary alkyl polyoxyalkylene surfactants having the formula:

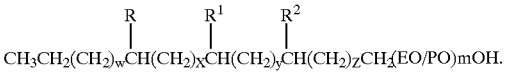

The surfactant mixtures of the present invention comprise molecules having a linear primary polyoxyalkylene chain backbone (i.e., the longest linear carbon chain which includes the alkoxylated carbon atom). These alkyl chain backbones comprise from 9 to 18 carbon atoms; and further the molecules comprise a branched primary alkyl moiety or moieties having at least about 1, but not more than 3, carbon atoms. In addition, the surfactant mixture has an average total number of carbon atoms for the branched primary alkyl moieties within the range of from greater than about 12 to about 14.5. Thus, the present invention mixtures comprise at least one polyoxyalkylene compound having a longest linear carbon chain of not less than 9 carbon atoms or more than 17 carbon atoms, and further the average total number of carbon atoms for the branched primary alkyl chains is within the range of greater than 12 to about 14.5, preferably greater than about 12 to about 14 and most preferably greater than about 12 to about 13.5.

For example, a C14 total carbon primary polyoxyalkylene surfactant having 11 carbon atoms in the backbone must have 1, 2 or 3 branching units (i.e. R, $R^1$ and $R^2$) whereby the total number of carbon atoms in the molecule is 14. In this example, the C14 total carbon requirement may be satisfied equally by having, for example, one propyl branching unit or three methyl branching units.

R, $R^1$, and $R^2$ are each independently selected from hydrogen and $C_1$–$C_3$ alkyl (preferably hydrogen or $C_1$–$C_2$ alkyl, more preferably hydrogen or methyl, and most preferably methyl), provided R, $R^1$, and $R^2$ are not all hydrogen. Further, when z is 0, at least R or $R^1$ is not hydrogen.

Although for the purposes of the present invention surfactant compositions the above formula does not include molecules wherein the units R, $R^1$, and $R^2$ are all hydrogen (i.e., linear non-branched primary polyoxyalkylenes), it is to be recognized that the present invention compositions may still further comprise some amount of linear, non-branched primary polyoxyalkylene. Further, this linear non-branched primary polyoxyalkylene surfactant may be present as the result of the process used to manufacture the surfactant mixture having the requisite mid-chain branched primary polyoxyalkylenes according to the present invention, or for purposes of formulating detergent compositions some amount of linear non-branched primary polyoxyalkylene may be admixed into the final product formulation.

Further it is to be similarly recognized that non-alkoxylated mid-chain branched alcohol may comprise some amount of the present invention polyoxyalkylene-containing compositions. Such materials may be present as the result of incomplete alkoxylation of the alcohol used to prepare the polyoxyalkylene surfactant, or these alcohols may be separately added to the present invention detergent compositions along with a mid-chain branched polyoxyalkylene surfactant according to the present invention.

Further regarding the above formula, w is an integer from 0 to 10; x is an integer from 0 to 10; y is an integer from 0 to 10; z is an integer from 0 to 10; and w+x+y+z is an integer from 2 to 11.

EO/PO are alkoxy moieties, preferably selected from ethoxy, propoxy, and mixed ethoxy/propoxy groups, more preferably ethoxy, wherein m is at least about 1, preferably within the range of from about 3 to about 30, more preferably from about 5 to about 20, and most preferably from about 5 to about 15. The $(EO/PO)_m$ moiety may be either a distribution with average degree of alkoxylation (e.g., ethoxylation and/or propoxylation) corresponding to m, or it may be a single specific chain with alkoxylation (e.g., ethoxylation and/or propoxylation) of exactly the number of units corresponding to m.

The preferred surfactant mixtures of the present invention have at least about 10%, more preferably at least about 20%, even more preferably at least about 30% and most preferably at least about 50%, by weight, of the mixture of one or more mid-chain branched primary alkyl polyoxyalkylenes having the formula:

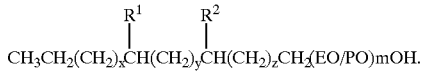

Wherein the total number of carbon atoms, including branching, is from 10 to 16, and the average total number of carbon atoms in the branched primary alkyl moieties is within the range of greater than 12 to about 14. $R^1$ and $R^2$ are each independently hydrogen or $C_1$–$C_3$ alkyl; xis from 0 to 10; y is from 0 to 10; z is from 0 to 10; and x+y+z is from 4 to 10. Provided $R^1$ and $R^2$ are not both hydrogen. EO/PO are alkoxy moieties selected from ethoxy, propoxy, and mixed ethoxy/propoxy groups, more preferably ethoxy, wherein m is at least about 1, preferably within the range of from about 3 to about 30, more preferably from about 5 to about 20, and most preferably from about 5 to about 15. More preferred are compositions having at least 5% of the mixture comprising one or more mid-chain branched primary polyoxyalkylenes wherein z is at least 1.

Preferably, the mixtures of surfactant comprise at least 5%, preferably at least about 20%, of a mid chain branched primary alkyl polyoxyalkylene having $R^1$ and $R^2$ independently hydrogen or methyl. Provided $R^1$ and $R^2$ are not both hydrogen and x+y is equal to 5, 6 or 7 and z is at least 1.

Preferred detergent compositions according to the present invention, for example one useful for laundering fabrics, comprise from about 0.001% to about 99% of a mixture of mid-chain branched primary alkyl polyoxyalkylene surfactants, said mixture comprising at least about 5% by weight of one or more mid-chain branched alkyl polyoxyalkylenes having the formula:

(I)

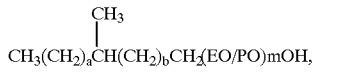

(II)

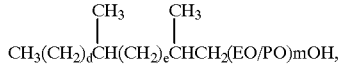

and mixtures thereof.

Wherein a, b, d, and e are integers, and a+b is from 6 to 13, d+e is from 4 to 11. Further, when a+b=6, a is an integer from 2 to 5 and b is an integer from 1 to 4;

when a+b=7, a is an integer from 2 to 6 and b is an integer from 1 to 5;

when a+b=8, a is an integer from 2 to 7 and b is an integer from 1 to 6;

when a+b=9, a is an integer from 2 to 8 and b is an integer from 1 to 7;

when a+b=10, a is an integer from 2 to 9 and b is an integer from 1 to 8;

when a+b=11, a is an integer from 2 to 10 and b is an integer froi 1 to 9;

when a+b=12, a is an integer from 2 to 11 and b is an integer from 1 to 10;

when a+b=13, a is an integer from 2 to 12 and b is an integer from 1 to 11;

when d+e=4, d is an integer from 2 to 3 and e is an integer from 1 to 2;

when d+e=5, d is an integer from 2 to 4 and e is an integer from 1 to 3;

when d+e=6, d is an integer from 2 to 5 and e is an integer from 1 to 4;

when d+e=7, d is an integer from 2 to 6 and e is an integer from 1 to 5;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9.

Further, the average total number of carbon atoms in the branched primary alkyl moieties having the above formulas is within the range of greater than about 12 to about 14.5. EO/PO are alkoxy moieties selected from ethoxy, propoxy, and mixed ethoxy/propoxy groups. Wherein m is at least about 1, preferably within the range of from about 3 to about 30, more preferably from about 5 to about 20, and most preferably from about 5 to about 15.

Further, the present invention surfactant composition may comprise a mixture of branched primary alkyl polyoxyalkylenes having the formula:

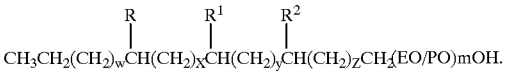

Wherein the total number of carbon atoms per molecule, including branching, is from 10 to 17, and the average total number of carbon atoms in the branched primary alkyl moieties having the above formula is within the range of greater than about 12 to about 14.5. R, $R^1$, and $R^2$ are each independently selected from hydrogen and $C_1$–$C_3$ alkyl, provided R, $R^1$, and $R^2$ are not all hydrogen. w is an integer from 0 to 10; x is an integer from 0 to 10; y is an integer from 0 to 10; z is an integer from 0 to 10; w+x+y+z is from 3 to 10. EO/PO are alkoxy moieties, preferably selected from ethoxy, propoxy, and mixed ethoxy/propoxy groups, wherein m is at least about 1, preferably within the range of from about 3 to about 30, more preferably from about 5 to about 20, and most preferably from about 5 to about 15. Provided when $R^2$ is $C_1$–$C_3$ alkyl the ratio of surfactants having z equal to 2 or greater to surfactants having z of 1 is at least about 1:1, preferably at least about 1.5:1, more preferably at least about 3:1, and most preferably at least about 4:1. Also preferred are surfactant compositions when $R^2$ is $C_1$–$C_3$ alkyl comprising less than about 50%, preferably less than about 40%, more preferably less than about 25%, most preferably less than about 20%, of branched primary alkyl polyoxyalkylene having the above formula wherein z equals 0.

Preferred mono-methyl branched primary alkyl ethoxylates are selected from the group consisting of: 3-methyl dodecanol ethoxylate, 4-methyl dodecanol ethoxylate, 5-methyl dodecanol ethoxylate, 6-methyl dodecanol ethoxylate, 7-methyl dodecanol ethoxylate, 8-methyl dodecanol ethoxylate, 9-methyl dodecanol ethoxylate, 10-methyl dodecanol ethoxylate, 3-methyl tridecanol ethoxylate, 4-methyl tridecanol ethoxylate, 5-methyl tridecanol ethoxylate, 6-methyl tridecanol ethoxylate, 7-methyl tridecanol ethoxylate, 8-methyl tridecanol ethoxylate, 9-methyl tridecanol ethoxylate, 10-methyl tridecanol ethoxylate, 11-methyl tridecanol ethoxylate, and mixtures thereof, wherein the compounds are ethoxylated with an average degree of ethoxylation of from about 5 to about 15.

Preferred di-methyl branched primary alkyl ethoxylates selected from the group consisting of: 2,3-dimethyl undecanol ethoxylate, 2,4-dimethyl undecanol ethoxylate, 2,5-dimethyl undecanol ethoxylate, 2,6-dimethyl undecanol ethoxylate, 2,7-dimethyl undecanol ethoxylate, 2,8-dimethyl undecanol ethoxylate, 2,9-dimethyl undecanol ethoxylate, 2,3-dimethyl dodecanol ethoxylate, 2,4-dimethyl dodecanol ethoxylate, 2,5-dimethyl dodecanol ethoxylate, 2,6-dimethyl dodecanol ethoxylate, 2,7-dimethyl dodecanol ethoxylate, 2,8-dimethyl dodecanol ethoxylate, 2,9-dimethyl dodecanol ethoxylate, 2,10-dimethyl dodecanol ethoxylate, and mixtures thereof, wherein the compounds are ethoxylated with an average degree of ethoxylation of from about 1 to about 15.

Preparation of Mid-chain Branched Surfactants

The following reaction scheme outlines a general approach to the preparation of the mid-chain branched primary alcohol useful for alkoxylating and/or sulfating to prepare the mid-chain branched primary alkyl surfactants of the present invention.

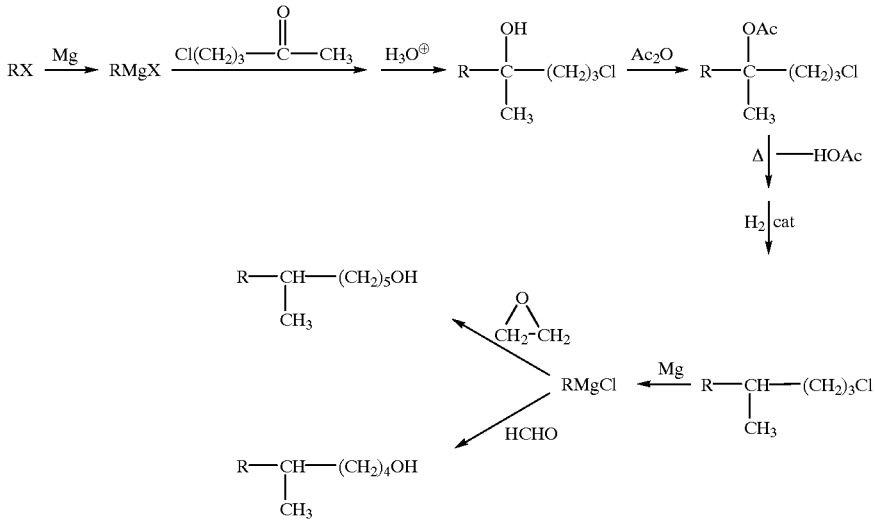

An alkyl halide is converted to a Grignard reagent and the Grignard is reacted with a haloketone. After conventional acid hydrolysis, acetylation and thermal elimination of acetic acid, an intermediate olefin is produced (not shown in the scheme) which is hydrogenated forthwith using any convenient hydrogenation catalyst such as Pd/C.

This route is favorable over others in that the branch, in this illustration a 5-methyl branch, is introduced early in the reaction sequence.

Formulation of the alkyl halide resulting from the first hydrogenation step yields alcohol product, as shown in the scheme. This can be alkoxylated using standard techniques and/or sulfated using any convenient sulfating agent, e.g., chlorosulfonic acid, $SO_3$/air, or oleum, to yield the final branched primary alkyl surfactant. There is flexibility to extend the branching one additional carbon beyond that which is achieved by a single formulation. Such extension can, for example, be accomplished by reaction with ethylene oxide. See "Grignard Reactions of Nonmetallic Substances", M. S. Kharasch and O. Reinmuth, Prentice-Hall, N.Y., 1954; *J. Org. Chem.*, J. Cason and W. R. Winans, Vol. 15 (1950), pp 139–147; *J. Org Chem.*, J. Cason et al., Vol. 13 (1948), pp 239–248; *J Org Chem.*, J. Cason et al., Vol. 14 (1949), pp 147–154; and *J Org Chem.*, J. Cason et al., Vol. 15 (1950), pp 135–138 all of which are incorporated herein by reference.

In variations of the above procedure, alternate haloketones or Grignard reagents may be used. PBr3 halogenation of the alcohol from formulation or ethoxylation can be used to accomplish an iterative chain extension.

The preferred mid-chained branched primary alkyl alkoxylated sulfates (as well as the polyoxyalkylenes and alkyl sulfates, by choosing to only alkoxylate or sulfate the intermediate alcohol produced) of the present invention can also be readily prepared as follows:

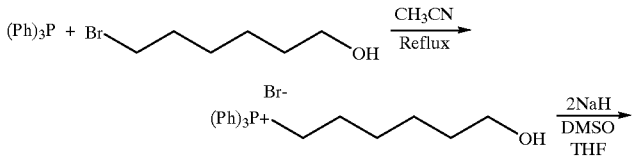

-continued

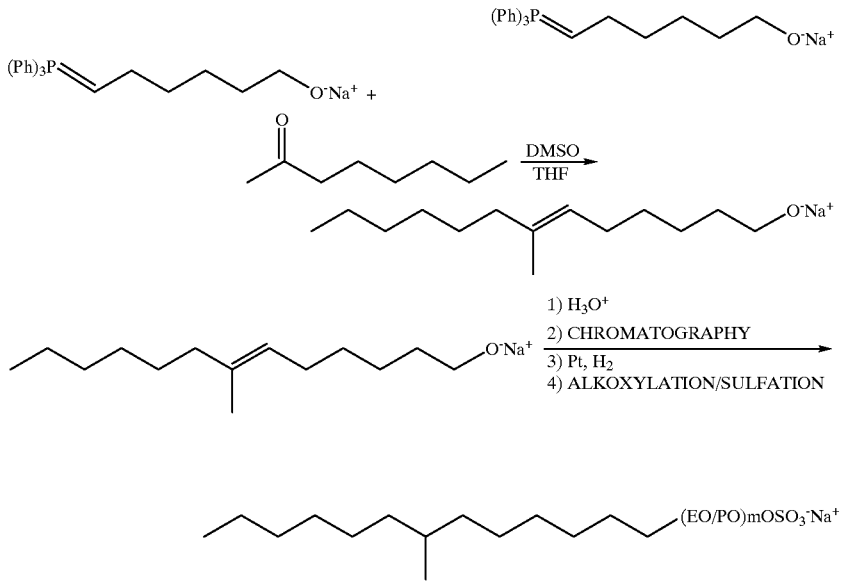

A conventional bromoalcohol is reacted with triphenylphosphine followed by sodium hydride, suitably in dimethylsulfoxide/tetrahydrofuran, to form a Wittig adduct. The Wittig adduct is reacted with an alpha methyl ketone, forming an internally unsaturated methyl-branched alcoholate. Hydrogenation followed by alkoxylation and/or sulfation yields the desired mid-chain branched primary alkyl surfactant. Although the Wittig approach does not allow the practitioner to extend the hydrocarbon chain, as in the Grignard sequence, the Wittig typically affords higher yields. See *Agricultural and Biological Chemistry*, M. Horiike et al., vol. 42 (1978), pp 1963–1965 included herein by reference.

Any alternative synthetic procedure in accordance with the invention may be used to prepare the branched primary alkyl surfactants. The mid-chain branched primary alkyl surfactants may, in addition be synthesized or formulated in the presence of the conventional homologs, for example any of those which may be formed in an industrial process which produces 2-alkyl branching as a result of hydroformylation.

In certain preferred embodiments of the surfactant mixtures of the present invention, especially those derived from fossil fuel sources involving commercial processes, said surfactant mixtures comprise at least 1 mid-chain branched primary alkyl surfactant, preferably at least 2, more preferably at least 5, most preferably at least 8. Particularly suitable for preparation of certain surfactant mixtures of the present invention are "oxo" reactions wherein a branched chain olefin is subjected to catalytic isomerization and hydroformylation prior to alkoxylation and/or sulfation. The preferred processes resulting in such mixtures utilize fossil fuels as the starting material feedstock. Preferred processes utilize Oxo reaction on olefins (alpha or internal) with a limited amount of branching. Suitable olefins may be made by dimerization of linear alpha or internal olefins, by controlled oligomerization of low molecular weight linear olefins, by skeletal rearrangement of detergent range olefins, by dehydrogenation/skeletal rearrangement of detergent range paraffins, or by Fischer-Tropsch reaction. These reactions will in general be controlled to:

1) give a large proportion of olefins in the desired detergent range (while allowing for the addition of a carbon atom in the subsequent Oxo reaction),
2) produce a limited number of branches, preferably mid-chain,
3) produce $C_1$–$C_3$ branches, more preferably ethyl, most preferably methyl,
4) limit or eliminate gem dialkyl branching i.e. to avoid formation of quaternary carbon atoms.

The suitable olefins can undergo Oxo reaction to give primary alcohols either directly or indirectly through the corresponding aldehydes. When an internal olefin is used, an Oxo catalyst is normally used which is capable of prior pre-isomerization of internal olefins primarily to alpha olefins. While a separately catalyzed (i.e. non-Oxo) internal to alpha isomerization could be effected, this is optional. On the other hand, if the olefin-forming step itself results directly in an alpha olefin (e.g. with high pressure Fischer-Tropsch olefins of detergent range), then use of a non-isomerizing Oxo catalyst is not only possible, but preferred.

The process described herein above, with tridecene, gives the more preferred 5-methyl-tridecyl alcohol and therefore surfactants in higher yield than the less preferred 2,4-dimethyldodecyl materials. This mixture is desirable under the metes and bounds of the present invention in that each product comprises a total of 14 carbon atoms with linear alkyl chains having at least 12 carbon atoms.

The following examples provide methods for synthesizing various compounds useful in the present invention compositions.

The following two analytical methods for characterizing branching in the present invention surfactant compositions are useful:

1) Separation and Identification of Components in Fatty Alcohols (prior to alkoxylation or after hydrolysis of alcohol sulfate for analytical purposes). The position and length of branching found in the precursor fatty alcohol materials is determined by GC/MS techniques

[see: D. J. Harvey, Biomed, Environ. Mass Spectrom (1989). 18(9), 719–23; D. J. Harvey, J. M. Tiffany, J. Chromatogr. (1984), 301(1), 173–87; K. A. Karlsson, B. E. Samuelsson, G. O. Steen, Chem. Phys. Lipids (1973), 11(1), 17–38].

2) Identification of Separated Fatty Alcohol Alkoxy Sulfate Components by MS/MS. The position and length of branching is also determinable by Ion Spray-MS/MS or FAB-MS/MS techniques on previously isolated fatty alcohol sulfate components.

The average total carbon atoms of the branched primary alkyl surfactants herein can be calculated from the hydroxyl value of the precursor fatty alcohol mix or from the hydroxyl value of the alcohols recovered by extraction after hydrolysis of the alcohol sulfate mix according to common procedures, such as outlined in "Bailey's Industrial Oil and Fat Products", Volume 2, Fourth Edition, edited by Daniel Swern, pp. 440–441.

Aqueous Liquid Carrier

The light duty dishwashing detergent compositions herein further contain from about 30% to 95% of an aqueous liquid carrier in which the other essential and optional compositions components are dissolved, dispersed or suspended. More preferably the aqueous liquid carrier will comprise from about 50% to 65% of the compositions herein.

One essential component of the aqueous liquid carrier is, of course, water. The aqueous liquid carrier, however, may contain other materials which are liquid, or which dissolve in the liquid carrier, at room temperature and which may also serve some other finction besides that of a simple filler. Such materials can include, for example, hydrotropes and solvents. Due in large part to the properties of the mid-chain branched surfactants of the present invention, the water in the aqueous liquid carrier can have a hardness level of at least about 15 gpg or more ("gpg" is a measure of water hardness that is well known to those skilled in the art, and it stands for "grains per gallon").

a) Hydrotropes

The aqueous liquid carrier may comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. The liquid detergent composition of the present invention preferably comprises from about 0.5% to 8%, by weight of the liquid detergent composition of a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials can be present in the composition to the extent of from about 0.5% to 8% by weight.

b) Solvents

A variety of water-miscible liquids such as lower alkanols, diols, other polyols, ethers, amines, and the like may be used as part of the aqueous liquid carrier. Particularly preferred are the $C_1$–$C_4$ alkanols. Such solvents can be present in the compositions herein to the extent of from about 1% to 8%.

Optional Ingredients

Preferred optional ingredients in the dishwashing compositions herein include, anionic and nonionic surfactants, ancillary surfactants, calcium and/or magnesium ions, enzymes such as protease, and a stabilizing system for the enzymes. These and other optional ingredients are described as follows:

Anionic Surfactant Component

In addition to the branched surfactant mixture disclosed above, the compositions herein can contain from about 5% to 40% of an anionic surfactant component. More preferably the anionic surfactant component comprises from about 15% to 35% of the compositions herein.

The anionic surfactant component preferably comprises alkyl sulfates and alkyl ether sulfates derived from conventional alcohol sources, e.g., natural alcohols, synthetic alcohols such as those sold under the trade name of NEODO™, ALFO™, LIAL™, LUTENSOL™ and the like. Alkyl ether sulfates are also known as alkyl polyethoxylate sulfates. These ethoxylated alkyl sulfates are those which correspond to the formula:

$$R'—O—(C_2H_4O)_nSO_3M$$

wherein R' is a $C_8$–$C_{18}$ alkyl group, n is from about 0.01 to 6, and M is a salt-forming cation. Preferably, R' is $C_{10\text{-}16}$ alkyl, n is from about 0.01 to 4, and M is sodium, potassium, ammonium, alkylammonium, or alkanolammonium. Most preferably, R' is $C_{12}$–$C_{16}$, n is from about 0.01 to 3 and M is sodium. The alkyl ether sulfates will generally be used in the formn of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0.

Other anionic surfactants usefuil for detersive purposes can also be included in the compositions hereof. These can include salts (including, for example, sodium, potassium, ammonium, and substituted ammonium salts such as mono-, di- and triethanolamine salts) of soap, $C_9C_{15}$ linear alkylbenzenesulphonates, $C_8$–$C_{22}$ primary or secondary alkanesulphonates, $C_9$–$C_{22}$ olefin sulphonates, sulphonated polycarboxylic acids prepared by sulphonation of the pyrolyzed product of alkaline earth metal citrates, e.g., as described in British patent specification No. 1,082,179, $C_{8-22}$ alkyl glycerol sulfonates, fatty acyl glycerol sulfonates, fatty oleyl glycerol sulfates, $C_{11-16}$ secondary soaps, alkyl phenol ethylene oxide ether sulfates, paraffin sulfonates, alkyl phosphates, isethionates such as the acyl isethionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, $C_{12-16}$ alkyl polyalkoxy carboxylates such as those of the formula $RO(CH_2CH_2O)_kCH_2COO\text{-}M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

One type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Especially preferred are the methyl ester sulfonates wherein the alkyl group is $C_{12}$–$C_{16}$.

Secondary Surfactants

Secondary detersive surfactant can be selected from the group consisting of nonionics, cationics, ampholytics, zwitterionics, and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described below.

Nonionic Surfactants

In addition to the branched surfactant mixture disclosed above, the compositions herein can also contain from about 3% to 10% of a certain type of nonionic surfactant component. More preferably, the nonionic surfactant component will comprise from about 4% to 6% of the compositions herein. Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl dialkyl arnine oxide, alkyl ethoxylate, alkanoyl glucose amide, alkyl betaines, and mixtures thereof.

One essential type of nonionic surfactant which is present in the compositions herein comprises the $C_8$–$C_{18}$, preferably $C_{10}$–$C_{16}$, polyhydroxy fatty acid amides. These materials are more fully described in Pan/Gosselink; U.S. Pat. No. 5,332,528; Issued Jul. 26, 1994, which is incorporated herein by reference. These polyhydroxy fatty acid amides have a general structure of the formula:

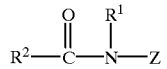

wherein $R^1$ is H, $C_1$–$C_4$ hydrocarbyl, 2-hydroxyethyl, 2-hydroxypropyl, or a mixture thereof; $R^2$ is $C_8$–$C_{18}$ hydrocarbyl; and Z is a polyhydroxylhydrocarbyl having a linear hydrocarbyl chain with at least 3 hydroxyls directly connected to the chain, or an alkoxylated derivative thereof Examples of such surfactants include the $C_{10}$–$C_{18}$ N-methyl, or N-hydroxypropyl, glucamides. The N-propyl through N-hexyl $C_{12}$–$C_{16}$ glucamides can be used for lower sudsing performance. Polyhydroxy fatty acid amides will preferably comprise from about 1% to 5% of the compositions herein.

In the nonionic surfactant component of the compositions herein, the polyhydroxy fatty acid amides hereinbefore described may be combined with certain other types of nonionic co-surfactants. These other types include ethoxylated alcohols and ethylene oxide-propylene oxide block co-polymer surfactants, as well as combinations of these nonionic co-surfactant types.

Other nonionic surfactants for use herein include: the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

Ethoxylated alcohol surfactant materials useful in the nonionic surfactant component herein are those which correspond to the general formula:

$$R^1\text{—}O\text{—}(C_2H_4O)_nH$$

wherein $R^1$ is a $C_8$–$C_{18}$ alkyl group and n ranges from about 5 to 15. Preferably $R^1$ is an alkyl group, which may be primary or secondary, that contains from about 9 to 15 carbon atoms, more preferably from about 9 to 12 carbon atoms. Preferably the ethoxylated fatty alcohols will contain from about 2 to 12 ethylene oxide moieties per molecule, more preferably from about 8 to 12 ethylene oxide moieties per molecule. The ethoxylated fatty alcohol nonionic co-surfactant will frequently have a hydrophilic-lipophilic balance (HLB) which ranges from about 6 to 15, most preferably from about 10 to 15.

Examples of fatty alcohol ethoxylates useful as the nonionic co-surfactant component of the compositions herein will include those which are made from alcohols of 12 to 15 carbon atoms and which contain about 7 moles of ethylene oxide. Such materials have been commercially marketed under the tradenanes Neodol 25-7 and Neodol 23-6.5 by Shell Chemical Company. Other useful Neodols include Neodol 1-5, ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylate nonionics useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

Ethoxylated alcohol nonionic co-surfactants will frequently comprise from about 0.2% to 4% of the compositions herein. More preferably, such ethoxylated alcohols will comprise from about 0.5% to 1.5% of the compositions.

Another type of nonionic co-surfactant suitable for use in combination with the nonionic surfactant component herein comprises the ethylene oxide-propylene oxide block co-polymers that function as polymeric surfactants. Such block co-polymers comprise one or more groups which are hydrophobic and which contain mostly ethylene oxide moieties and one or more hydrophobic groups which contain mostly propylene oxide moieties. Such groups are attached to the residue of a compound that contained one or more hydroxy groups or amine groups. Such polymeric surfactants have a molecular weight ranging from about 400 to 60,000.

Preferred ethylene oxide-propylene oxide polymeric surfactants are those in which propylene oxide is condensed with an amine, especially a diamine, to provide a base that is then condensed with ethylene oxide. Materials of this type are marketed under the tradename Tetronic®. Similar structures wherein the ethylene diamine is replaced with a polyol such as propylene glycol are marketed under the tradename "Pluronic®". Preferred ethylene oxide-propylene oxide (EO-PO) polymeric surfactants have an HLB which ranges from about 4 to 30, more preferably about 10 to 20.

The ethylene oxide-propylene oxide block co-polymers used herein are described in greater detail in Pancheri/Mao; U.S. Pat. No. 5,167,872; Issued Dec. 2, 1992. This patent is incorporated herein by reference.

Ethylene oxide-propylene oxide block co-polymers will frequently be present to the extent of from about 0.1% to 2% of the compositions herein. More preferably, these polymeric surfactant materials will comprise from about 0.2% to 0.8% of the compositions herein.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the I-position). The additional glycosyl units can then be attached between their l-position and the preceding glycosyl units 2-, 3-, 4- and/or 6-position, preferably predominantly the 2-position.

Suds Boosters/Stabilizers

The compositions herein can further include from about 2% to 8%, preferably from about 3% to 6%, of a suds booster or stabilizer component such as betaine surfactants, fatty acid alkanol amides, amine oxide semi-polar nonionic surfactants, and $C_{8-22}$ alkyl polyglycosides. Combinations of these suds boosters/stabilizers can also be used.

Betaine surfactants useful as suds boosters herein have the general formula:

$$R—\overset{(+)}{N}(R^1)_2—R^2\overset{(-)}{COO}$$

wherein R is a hydrophobic group selected from alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amino or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Alkanol amide surfactants useful as suds boosters herein include the ammonia, monoethanol, and diethanol amides of fatty acids having an acyl moiety containing from about 8 to about 18 carbon atoms. These materials are represented by the formula:

$$R_1—CO—N(H)_{m-1}(R_2OH)_{3-m}$$

wherein $R_1$ is a saturated or unsaturated, hydroxy-free aliphatic hydrocarbon group having from about 7 to 21, preferably from about 11 to 17 carbon atoms; $R_2$ represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of $C_{12-14}$ fatty acids are preferred.

Amine oxide semi-polar nonionic surfactants useful as suds boosters/stabilizers comprise compounds and mixtures of compounds having the formula:

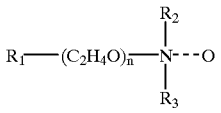

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

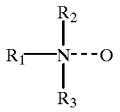

wherein $R_1$ is a $C_{12-16}$ alkyl and $R_2$ and $R_3$ are methyl or ethyl. The above hydroxy-free amides, and amine oxides are more fully described in U.S. Pat. No. 4,316,824, incorporated herein by reference.

Other surfactants suitable for use as suds boosters/stabilizers in the compositions herein are the nonionic fatty alkylpolyglycosides. Such materials have the formula:

$$R_2O(C_nH_{2n}O)_y(Z)_x$$

wherein Z is derived from glucose, R is a hydrophobic group selected from alkyl, alkylphenyl, hydroxyalkylphenyl, and mixtures thereof in which said alkyl groups contain from 8 to 22, preferably from 12 to 14 carbon atoms; n is 2 or 3 preferably 2, y is from 0 to 10, preferably 0; and x is from 1.5 to 8, preferably from 1.5 to 4, most preferably from 1.6 to 2.7. U.S. Pat. Nos. 4,393,203 and 4,732,704, incorporated herein by reference, describe these alkyl polyglycoside surfactants.

Thickener

The dishwashing detergent compositions herein can also contain from about 0.2% to 5% of a thickening agent. More preferably, such a thickener will comprise from about 0.5% to 2.5% of the compositions herein. Thickeners are typically selected from the class of cellulose derivatives. Suitable thickeners include hydroxy ethyl cellulose, hydroxyethyl methyl cellulose, carboxy methyl cellulose, Quatrisoft LM200, and the like. A preferred thickening agent is hydroxypropyl methylcellulose.

The hydroxypropyl methylcellulose polymer has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

When formulated into the dishwashing detergent compositions of the present invention, the hydroxypropyl methylcellulose polymer should impart to the detergent composition a Brookfield viscosity of from about 500 to 3500 cps at 25° C. More preferably, the hydroxypropyl methylcellulose material will impart a viscosity of from about 1000 to 3000 cps at 25° C. For purposes of this invention, viscosity is measured with a Brookfield LVTDV-11 viscometer apparatus using an RV #2 spindle at 12 rpm.

Calcium and/or Magnesium Ions

The presence of calcium and/or magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention herein containing magnesium and/or calcium ions exhibit good grease removal, manifest mildness to the skin, and provide good storage stability. These ions can be present in the compositions herein at an active level of from about 0.1% to 4%, preferably from about 0.3% to 3.5%, more preferably from about 0.5% to 1%, by weight.

Preferably, the magnesium or calcium ions are added as a hydroxide, chloride, acetate, formate, oxide or nitrate salt to the compositions of the present invention. Calcium ions may also be added as salts of the hydrotrope.

The amount of calcium or magnesium ions present in compositions of the invention will be dependent upon the amount of total surfactant present therein. When calcium ions are present in the compositions of this invention, the molar ratio of calcium ions to total anionic surfactant should be from about 0.25:1 to about 2:1.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

Protease and/or Other Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase.

The compositions of this invention can also optionally contain from about 0.0001% to about 5%, more preferably from about 0.003% to about 4%, most preferably from about 0.005% to about 3%, by weight, of active protease, i.e., proteolytic, enzyme. Protease activity may be expressed in Anson units (AU.) per kilogram of detergent composition. Levels of from 0.01 to about 150, preferably from about 0.05 to about 80, most preferably from about 0.1 to about 40 AU. per kilogram have been found to be acceptable in compositions of the present invention.

Useful proteolytic enzymes can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades's Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent EP-B-251,446, granted Dec. 28, 1994 and published Jan. 7, 1988 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733. Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27 +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Other optional enzymes such as lipase and/or amylase may be also added to the compositions of the present invention for additional cleaning benefits.

Cellulases—the cellulases usable in the present invention include both bacterial or fungal cellulase. Suitable cellulases are disclosed in U.S. Pat. No. 4,435,307, Barbesgoard et al, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

Lipase

Suitable lipase enzymes include those produced by microorganisms of the Pseudomonas group, such as *Pseudomonas stutzeri* ATCC19.154, as disclosed in British Patent 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano- P". Further suitable lipases are lipases such as M1 Lipase® and Lipomax® (Gist-Brocades). Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from Humicola lanuginosa as described in U.S. Ser. No. 08/341,826. (See also patent application WO 92/05249 viz. wherein the native lipase ex Humicola lanuginosa aspartic acid (D) residue at position 96 is changed to Leucine (L). According to this nomenclature said substitution of aspartic acid to Leucine in position 96 is shown as: D96L.) Preferably the Humicola lanuginosa strain DSM 4106 is used.

In spite of the large number of publications on lipase enzymes, only the lipase derived from *Humicola lanuginosa* and produced in *Aspergillus oryzae* as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5-500,000 LU/liter) lipase variant per liter of wash liquor.

Also suitable are cutinases [$EC_{3.1.1.50}$] which can be considered as a special kind of lipase, namely lipases which do not require interfacial activation. Addition of cutinases to detergent compositions have been described in e.g. WO-A-88/09367 (Genencor).

The lipases and/or cutinases are normally incorporated in the detergent composition at levels from 0.0001% to 2% of active enzyme by weight of the detergent composition.

Amylase

Amylases (α and/or β) can be included for removal of carbohydrate-based stains. Suitable amylases are Termamyl (Novo Nordisk), Fungamyl® and BANt (Novo Nordisk). The enzymes may be of any suitable origin, such as vegetable, animal, bacterial, fungal and yeast origin. Amylase enzymes are normally incorporated in the detergent composition at levels from 0.0001% to 2% of active enzyme by weight of the detergent composition.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference. or an α-amylase being at least 80% homologous with the amino acid sequence shown in the SEQ ID listing.

(c) α-amylases according (a) comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935. In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e)α-arnylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those (α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase; the variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point pI) so as to better match the pI value for α-amylase variant to the pH of the medium.

The variants are described in the patent application PCTIDK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE (and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Enzyme Stabilizing System

The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. No. 4,261,868, Hora et al, issued Apr. 14, 1981; U.S. Pat. No. 4,404,115, Tai, issued Sep. 13, 1983; U.S. Pat. No. 4,318,818, Letton et al; U.S. Pat. No. 4,243,543, Guildert et al issued Jan. 6, 1981; U.S. Pat. No. 4,462,922, Boskamp, issued Jul. 31, 1984; U.S. Pat. No. 4,532,064, Boskamp, issued Jul. 30, 1985; and U.S. Pat. No. 4,537,707, Severson Jr., issued August 27, 1985, all of which are incorporated herein by reference.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Additionally, from 0% to about 10%, preferably from about 0.01% to about 6% by weight, of chlorine bleach or oxygen bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbonate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used.

Miscellaneous Optional Ingredients

Other conventional optional ingredients which are usually used in additive levels of below about 5% include opacifiers, antioxidants, bactericides, dyes, perfumes, and the like. Furthermore, detergency builders can also be present in the compositions herein in amounts of from 0% to about 50%, preferably from about 2% to about 30%, most preferably from about 5% to about 15%. It is typical in light-duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis (2-ethanol)blycine), citrate N-(2-hydroxylethyl) iminodiacetic acid (HIDA), N-(2,3-dihydroxy-propyl) diethanolamine, 1,2-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

Composition pH

The dishwashing compositions of the present invention will generally provide a 10% aqueous solution pH of from about 4 to 11. More preferably, the compositions herein will be alkaline in nature with a 10% aqueous solution pH of from about 7 to 10.5.

Dishwashing compositions of the invention will be subjected to acidic stresses created by food soils when put to use, i.e., diluted and applied to soiled dishes. If a composition with a pH greater than 7 is to be more effective, it should contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and tri-ethanolamine. Useful inorganic buffers/alkalinity sources include the alkali metal carbonates, e.g., sodium carbonate.

The buffering agent, if used, is present in the compositions of the invention herein at a level of from about 0. 1% to 15%, preferably from about 1% to 10%, most preferably from about 2% to 8%, by weight of the composition.

An especially preferred buffering agent are the class of materials known as organic diamines. Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diarnines are preferred over secondary and tertiary diamines.

Definition of pK1 and pK2

As used herein, "pK1" and "pK2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determnined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

The diamines useful herein can be defined by the following structure:

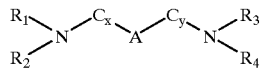

wherein $R^{1-4}$ are independently selected from H, methyl, —$CH_3CH_2$, and ethylene oxides; Cx and Cy are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Examples of preferred diamines include the following:

Dimethyl aminopropyl amine: 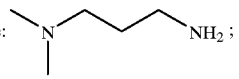

1,6-Hexane Diamine: 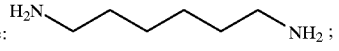

-continued 1,3 propane diamine - 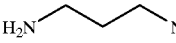

2-methyl 1,5 pentane diamine - 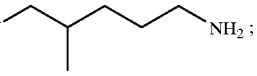

1,3-pentanediamine, available under the tradename Dytek EP 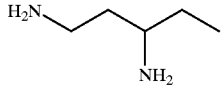

1-methyl-diaminopropane - 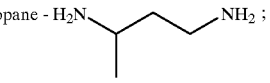

Jeffamine EDR 148 - 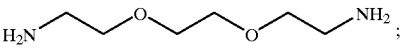

and mixtures thereof.

When tested as approximately equimolar replacements for Ca/Mg in the near neutral pH range (7–8), the organic diamines provided only parity grease cleaning performance to Ca/Mg. This achievement is not possible through the use of Ca/Mg or through the use of organic diamines below pH 8 or through the use of organic diamine diacid salts below pH 8.

Preferably the diamines used herein are pure or free of impurities. By "pure" is meant that the diamines are over 97% pure, i.e., preferably 98%, more preferably 99%, still more preferably 99.5%, free of impurities. Examples of impurities which may be present in commercially supplied diamines include 2-Methyl-1,3-diaminobutane and alkylhydropyrimidine. Further it is believed that the diamines should be free of oxidation reactants to avoid diamine degradation and ammonia formation. Additionally, if amine oxide and/or other surfactants are present, the amine oxide or surfactant should be hydrogen peroxide-free. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide. The compositions herein may additionally contain anti-oxidants to prevent ammonium formation upon aging due to oxygen uptake from air followed by diamine oxidation.

Composition Preparation

The liquid or gel dishwashing detergent compositions herein may be prepared by combining the essential and optional ingredients together in any convenient order using suitable agitation to form a homogeneous product. Preferred methods for making detergent compositions of the type disclosed herein, and for preparing various components of such compositions, are described in greater detail in Ofosu-Asante: U.S. Pat. No. 5,474,710: Issued Dec. 12, 1995. Due in large part to the chemical properties of the mid-chain branched surfactants of the present invention, the liquid detergent compositions defined herein are in one phase at temperatures greater than about 10° C., and during use can be diluted with water having a hardness of at least about 40 gpg with little or no degradation of performance.

Dishwashing Method

Soiled dishes can be contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgment of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another dishwashing method used worldwide involves direct application of the detergent compositions herein, either neat or diluted in a dispenser bottle, onto the soiled dishes to be cleaned. This can be accomplished by using a device for absorbing liquid dishwashing detergent, such as a sponge or dishrag, which is placed directly into a separate quantity of undiluted or somewhat diluted liquid dishwashing composition for a period of time typically ranging from about 1 to about 5 seconds. The absorbing device, and consequently the undiluted or somewhat diluted liquid dishwashing composition. can then be contacted individually with the surface of each of the soiled dishes to remove food soil. The absorbing device is typically contacted with each dish surface for a period of time ranging from about 1 to about 10 seconds, although the actual time of application will be dependent upon factors such as the degree of soiling of the dish. The contacting of the absorbing device with the dish surface is preferably accompanied by concurrent scrubbing. Prior to contact and scrubbing, this method may involve immersing the soiled dishes into a water bath without any liquid dishwashing detergent. After scrubbing, the dish can be rinsed under running water.

The following Examples are illustrative of the present invention and facilitate its understanding, but they are not meant to limit or otherwise define its scope. All parts, percentages and ratios used herein are expressed as percent weight unless otherwise specified.

EXAMPLE I

Preparation of sodium 7-methyltridecyl ethoxylated (E2) and sulfate Synthesis of (6-hydroxyhexyl) trithenylphosphonium bromide Into a 5L, 3 neck round bottom flask fitted with nitrogen inlet, condenser, thermometer, mechanical stirring and nitrogen outlet is added 6-bromo-1-hexanol (500 g, 2.76 mol), triphenylphosphine (768 g, 2.9 mol) and acetonitrile (1800 ml) under nitrogen. The reaction mixture is heated to reflux for 72 hrs. The reaction mixture is cooled to room temperature and transferred into a 5L beaker. The product is recrystallized from anhydrous ethyl ether (1.5L) at 10° C. Vacuum filtration followed by washing with ethyl ether and drying in a vacuum oven at 50° C. for 2 hrs. gives 1140 g of the desired product as white crystals.

Synthesis of 7-methyltridecene-1-ol

Into a dried 5L, 3 neck round bottom flask fitted with mechanical stirring, nitrogen inlet, dropping funnel, thermometer and nitrogen outlet is added 70.2 g of 60% sodium hydride (1.76 mol) in mineral oil. The mineral oil is removed by washing with hexanes. Anhydrous dimethyl sulfoxide (500 ml) is added to the flask and the mixture is heated to 70° C. until evolution of hydrogen stops. The reaction mixture is cooled to room temperature followed by addition of 1L of anhydrous tetrahydrofuran. (6-hydroxyhexyl) triphenylphosphonium bromide (443.4 g, 1 mol) is slurried with warm anhydrous dimethyl sulfoxide (50° C., 500 ml) and slowly added to the reaction mixture through the dropping funnel while keeping it at 25–30° C. The mixture is stirred for 30 minutes at room temperature at which time 2-octanone (140.8 g, 1.1 mol) is slowly added through a dropping funnel. Reaction is slightly exothermic and cooling is needed to maintain 25–30° C. The mixture is stirred for 18 hr. and then poured into a 5L beaker containing 1L purified water with stirring. The oil phase (top) is allowed to separate out in a separatory fimnel and the water phase is removed. The water phase is washed with hexanes (500 ml) and the organic phase is separated and combined with the oil phase from the water wash. The organic mixture is then extracted with water 3 times (500 ml each) followed by vacuum distillation to collect the clear, oily product (110 g) at 140° C. and 1 mm Hg.

Hydrogenation of 7-methyltridecene-1-ol

Into a 3L rocking autoclave liner is added 7-methyltridecene-1-ol (108 g, 0.508 mol), methanol (300 ml) and platinum on carbon (10% by weight, 35 g). The mixture is hydrogenated at 180° C. under 1200 psig of hydrogen for 13 hrs., cooled and vacuum filtered through Celite 545 with washing of the Celite 545, suitably with methylene chloride. If needed, the filtration can be repeated to eliminate traces of Pt catalyst, and magnesium sulfate can be used to dry the product. The solution of product is concentrated on a rotary evaporator to obtain a clear oil (104 g).

Alkoxylation of 7-methyltridecanol

Into a dried 1L 3 neck round bottom flask fitted with a nitrogen inlet, mechanical stirrer, and a y-tube fitted with a thermometer and a gas outlet is added the alcohol from the preceding step. For purposes of removing trace amounts of moisture, the alcohol is sparged with nitrogen for about 30 minutes at 80–100° C. Continuing with a nitrogen sweep, sodium metal is added as the catalyst and allowed to melt with stirring at 120–140° C. With vigorous stirring, ethylene oxide gas is added in 140 minutes while keeping the reaction temperature at 120–140° C. After the correct weight (equal to two equivalents of ethylene oxide) has been added, nitrogen is swept through the apparatus for 20–30 minutes as the sample is allowed to cool. The desired 7-methyltridecyl ethoxylate (average of 2 ethoxylates per molecule) product is then collected.

Sulfation of 7-methyltridecyl ethoxylate (E2)

Into a dried 1L 3 neck round bottom flask fitted with a nitrogen inlet, dropping funnel, thermometer, mechanical stirring and nitrogen outlet is added chloroform and 7-methyltridecyl ethoxylate (E2) from the preceding step. Chlorosulfonic acid is slowly added to the stirred mixture while maintaining 25–30° C. temperature with an ice bath. Once HCl evolution has stopped slowly add sodium methoxide (25% in methanol) while keeping temperature at 25–30° C. until a aliquot at 5% concentration in water maintains a pH of 10.5. To the mixture is added hot ethanol (55° C.) and vacuum filtered immediately. The filtrate is concentrated to a slurry on a rotary evaporator, cooled and then poured into ethyl ether. The mixture is chilled to 50° C. and vacuum filtered to provide the desired 7-methyltridecyl ethoxylate (average of 2 ethoxylates per molecule) sulfate, sodium salt, product.

EXAMPLE II

Preparation of mid-chain branched C12,13 and C14,15 sodium alcohol sulfate, alcohol ethoxylate, and sodium alcohol ethoxy (E1) sulfate from experimental clathrated Sasol Chemical Industries Prop. Ltd. ("Sasol") alcohol samples Experimental test mid-branched alcohol samples are derived by urea clathration of C12,13 and C14,15 detergent range alcohol samples from Sasol. Alcohol sulfates, alcohol ethoxylates, and alcohol ethoxy sulfates were prepared from the experimental alcohols. The urea clathration was used to separate the mid-chain branched alcohols from the high levels (35–45% by weight) of conventional linear alcohols present in Sasol's alcohol samples. A 10:1 to 20:1 molar ratio of urea to alcohol was used in the separation. Urea clathration is described in Advanced Organic Chemistry by J. March, 4th ed., Wiley and Sons, 1992, pp. 87–88 and by Takemoto; Sonoda, in Atwood; Davies; MacNicol treatise titled Inclusion Compounds, vol. 2, pp. 47–67. The original Sasol alcohol samples had been prepared by hydroformnylation of alpha olefins produced by Fischer Tropsch process as described by patents WO 97/01521 and according to the Sasol R&D technical product bulletin dated Oct. 1, 1996 entitled SASOL DETERGENT ALCOHOLS. The clathration procedure reduced the linear content from 35–45%, depending on the sample, down to about 5% by weight, leaving C12,13 and C14,15 alcohols that comprised about 95% branched alcohols. Of the branched alcohols, about 70% were mid-chain branched alcohols according to the present invention and the other 30% were alcohols branched at the 2-carbon position, counting from the oxygen in the alcohol. The sodium forms of alkyl sulfates and alkyl ethoxy (1) sulfates were synthesized for both the experimental mid-branched C12,13 and C14,15 alcohols. Further, alcohol ethoxylates were prepared in the range of 5 to 9 moles of ethoxylation.

Urea Clathration of Sasol C12,13 Alcohol

Into a dry 12 L 3 neck round bottom flask fitted with a mechanical stirrer is added Sasol C12,13 Alcohol (399.8 g, 2.05 mol) and urea (2398.8 g, 39.98 mol) and methanol (7 L). The reagents are allowed to stir atro eperature for about 20 hours. During this time, the urea forms a complex with the linear components of the Sasol alcohol but not with the branched components. After about 20 hours the suspension is filtered through a medium fritted funnel. Vacuum evaporation of the methanol followed by a hexane wash of the urea and vacuum evaporation of the hexane gives 189 g of almost colorless liquid. The GC analysis shows that the recovered alcohol is 5.4% linear and 94.6% branched. Of the branched alcohols, 67.4% are mid-chai n branched and 32.6% are branched at the 2-carbon position counting from the oxygen in the alcohol.

Sulfation of Sasol C12,13 Clathrated Alcohol

Into a dried 500 ml 3 neck round bottom flask fitted with a gas inlet, dropping funnel, mechanical stirrer, and a y-tube fitted with a thermometer and a gas outlet is added Sasol C12,13 Clathrated Alcohol (76.8 g, 0.4 mol) and diethyl ether (75 ml). Chlorosulfonic acid (48.9 g, 0.42 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCl. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (97.2 g, 0.45 mol) and methanol (300 ml) that is cooled in an ice water bath. After pH >12 is confirmed the solution is allowed to stir about 30 minutes then poured into a stainless pan. Most of the solvent is allowed to evaporate overnight in the fume hood. The next morning the sample is transferred to a glass dish and placed in a vacuum drying oven. The sample is allowed to dry all day and overnight at 40–60° C. with 25–30 inches Hg vacuum. After bottling 120 g of yellow tacky solid, the cat SO3 analysis shows the sample is about 94% active. The pH of the sample is about 11.9.

Ethoxylation of Sasol C12,13 Clathrated Alcohol to E1

Into a dried 500 ml 3 neck round bottom flask fitted with a gas inlet, mechanical stirrer, and a y-tube fitted with a thermometer and a gas outlet is added Sasol C12,13 Clathrated Alcohol (134.4 g, 0.7 mol). For the purpose of removing trace amounts of moisture, the alcohol is sparged with nitrogen for about 30 minutes at 60–80° C. Continuing with a nitrogen sweep, sodium metal (0.8 g, 0.04 mol) is added as the catalyst and allowed to melt with stirring at 120–140° C. With vigorous stirring, ethylene oxide gas (30.8 g, 0.7 mol) is added in 60 minutes while keeping the reaction temperature 120–140° C. After the correct weight of ethylene oxide is added, nitrogen is swept through the apparatus for 20–30 minutes as the sample is allowed to cool. The gold liquid product (164.0 g, 0.69 mol) is bottled under nitrogen.

Sulfation of Sasol C12,13 Clathrated Alcohol Ethoxylate (E1)

Into a dried 2L 3 neck round bottom flask fitted with a gas inlet, dropping funnel, mechanical stirrer, and a y-tube fitted with a thermometer and a gas outlet is added Sasol C12,13 Clathrated Ethoxylate (E1) (160.5 g, 0.68 mol) and diethyl ether (150 ml). Chlorosulfonic acid (82.7 g, 0.71 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCI. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (164.2 g, 0.76 mol) and methanol (500 ml) that is cooled in an ice water bath. After pH >12 is confirmed the solution is allowed to stir about 30 minutes then poured into a stainless pan. Most of the solvent is allowed to evaporate overnight in the fume hood. The next morning the sample is transferred to a glass dish and placed in a vacuum drying oven. The sample is allowed to dry all day and overnight at 40–60° C. with 25–30 inches Hg vacuum. After bottling 239 g of yellow tacky solid, the cat SO3 analysis shows the sample is about 87% active. The pH of the sample is about 12.6.

Urea Clathration of Sasol C14,15 Alcohol

Into a dry 12 L 3 neck round bottom flask fitted with a mechanical stirrer is added Sasol C14,15 Alcohol (414.0 g, 1.90 mol) and urea (2220.0 g, 37.0 mol) and methanol (3.5 L). The reagents are allowed to stir at room temperature for about 48 hours. During this time, the urea forms a complex with the linear components of the Sasol alcohol but not with the branched components. After about 48 hours the suspension is filtered through a medium fritted funnel. Vacuum evaporation of the methanol followed by a hexane wash of the urea and vacuum evaporation of the hexane gives 220 g of almost colorless liquid. The GC analysis shows that the recovered alcohol is 2.9% linear and 97.1% branched. Of the branched alcohols, 70.4% are mid-chain branched and 29.6% are branched at the 2-carbon position counting from the oxygen in the alcohol.

Sulfation of Sasol C14,15 Clathrated Alcohol

Into a dried 250 ml 3 neck round bottom flask fitted with a gas inlet, dropping funnel, mechanical stirrer, and a y-tube fitted with a thermometer and a gas outlet is added Sasol C14,15 Clathrated Alcohol (43.6 g, 0.2 mol) and diethyl ether (50 ml). Chlorosulfonic acid (24.5 g, 0.21 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCl. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (49.7 g, 0.23 mol) and methanol (200 ml) that is cooled in an ice water bath. After pH >12 is confirmed the solution is allowed to stir about 30 minutes then poured into a stainless pan. Most of the solvent is allowed to evaporate overnight in the fume hood. The next morning the sample is transferred to a glass dish and placed in a vacuum drying oven. The sample is allowed to dry all day and overnight at 40–60° C. with 25–30 inches Hg vacuum. After bottling 70 g of gold tacky solid, the cat SO3 analysis shows the sample is about 79% active. The pH of the sample is about 13.1.

Ethoxylation of Sasol C14,15 Clathrated Alcohol to E1

Into a dried 500 ml 3 neck round bottom flask fitted with a gas inlet, mechanical stirrer, and a y-tube fitted with a thermometer and a gas outlet is added Sasol C14,15 Clathrated Alcohol (76.3 g, 0.35 mol). For the purpose of removing trace amounts of moisture, the alcohol is sparged with nitrogen for about 30 minutes at 60–80° C. Continuing with a nitrogen sweep, sodium metal (0.4 g, 0.02 mol) is added as the catalyst and allowed to melt with stirring at 120–140° C. With vigorous stirring, ethylene oxide gas (15.4 g, 0.35 mol) is added in 35 minutes while keeping the reaction temperature 120–140° C. After the correct weight of ethylene oxide is added, nitrogen is swept through the apparatus for 20–30 minutes as the sample is allowed to cool. The gold liquid product (90 g, 0.34 mol) is bottled under nitrogen.

Sulfation of Sasol C14,15 Clathrated Alcohol Ethoxylate (E1)

Into a dried 500 ml 3 neck round bottom flask fitted with a gas inlet, dropping funnel, mechanical stirrer, and a y-tube fitted with a thermometer and a gas outlet is added Sasol C14,15 Clathrated Ethoxylate (E1) (86.5 g, 0.33 mol) and diethyl ether (100 ml). Chlorosulfonic acid (40.8 g, 0.35 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCl. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (82.1 g, 0.38 mol) and methanol (300 ml) that is cooled in an ice water bath. After pH >12 is confirmed the solution is allowed to stir about 30 minutes then poured into a stainless pan. Most of the solvent is allowed to evaporate overnight in the fume hood. The next morning the sample is transferred to a glass dish and placed in a vacuum drying oven. The sample is allowed to dry all day and overnight at 40–60° C. with 25–30 inches Hg vacuum. After bottling 125 g of gold tacky solid, the cat $SO_3$ analysis shows the sample is about 85% active. The pH of the sample is about 11.9.

EXAMPLE III

Prenaration of sodium 7-methylundecyl sulfate
Synthesis of 7-methylundecene-1-ol Into a dried 5L, 3 neck round bottom flask fitted with mechanical stirring, nitrogen inlet, dropping funnel, thermometer and nitrogen outlet is added 70.2 g of 60% sodium hydride (1.76 mol) in mineral oil. The mineral oil is removed by washing with hexanes. Anhydrous dimethyl sulfoxide (500 ml) is added to the flask and the mixture is heated to 70° C. until evolution of hydrogen stops. The reaction mixture is cooled to room temperature followed by addition of 1L of anhydrous tetrahydroftiran. (6-hydroxyhexyl) triphenylphosphonium bromide (443.4 g, 1 mol, prepared as described previously) is slurried with warm anhydrous dimethyl sulfoxide (500° C., 500 ml) and slowly added to the reaction mixture through the dropping funnel while keeping it at 25–30° C. The mixture is stirred for 30 minutes at room temperature at which time 2-hexanone (110 g, 1.1 mol) is slowly added through a dropping funnel. Reaction is slightly exothermic and cooling is needed to maintain 25–30° C. The mixture is stirred for 18 hr. and then poured into a 5L beaker containing 1L purified water with stirring. The oil phase (top) is allowed to separate out in a separatory funnel and the water phase is removed. The water phase is washed with hexanes (500 ml) and the organic phase is separated and combined with the oil phase from the water wash. The organic mixture is then extracted with water 3 times (500 ml each) followed by vacuum distillation to collect the clear, oily product at 140° C. and 1 mm Hg.

Hydrogenation of 7-methylundecene-1-ol

Into a 3L rocking autoclave liner is added 7-methylundecene-1-ol (93.5 g, 0.508 mol), methanol (300 ml) and platinum on carbon (10% by weight, 35 g). The mixture is hydrogenated at 180° C. under 1200 psig of hydrogen for 13 hrs., cooled and vacuum filtered through Celite 545 with washing of the Celite 545, suitably with methylene chloride. If needed, the filtration can be repeated to eliminate traces of Pt catalyst, and magnesium sulfate can be used to dry the product. The solution of product is concentrated on a rotary evaporator to obtain a clear oil.

Sulfation of 7-methylundecanol

Into a dried 1L 3 neck round bottom flask fitted with a nitrogen inlet, dropping funnel, thermometer, mechanical stirring and nitrogen outlet is added chloroform (300 ml) and 7-methylundecanol (93 g, 0.5 mol). Chiorosulfonic acid (60 g, 0.509 mol) is slowly added to the stirred mixture while maintaining 25–30° C. temperature with a ice bath. Once HCl evolution has stopped (1 hr.) slowly add sodium methoxide (25% in methanol) while keeping temperature at 25–30° C. until an aliquot at 5% concentration in water maintains a pH of 10.5. To the mixture is added hot ethanol (55° C., 2L). The mixture is vacuum filtered immediat ely. The filtrate is concentrated to a slurry on a rotary evaporator, cooled and then poured into 2L of ethyl ether. The mixture is chilled to 5° C., at which point crystallization occurs, and vacuum filtered. The crystals are dried in a vac uum oven at 50° C. for 3 hrs. to obtain a white solid.

EXAMPLE IV

Preparation of sodium 7-methyldodecyl sulfate
Synthesis of 7-methyldodecene-1-ol Into a dried 5L, 3 neck round bottom flask fitted with mechanical stirring, nitrogen inlet, dropping funnel, thermometer and nitrogen outlet is added 70.2 g of 60% sodium hydride (1.76 mol) in mineral oil. The mineral oil is removed by wa shing with hexanes. Anhydrous dimethyl sulfoxide (500 ml) is added to the flask and the mixture is heated to 70° C. until evolution of hydrogen stops. The reaction mixture is cooled to room temperature followed by addition of 1L of anhydrous tetrahydrofuran. (6-hydroxyhexyl) triphenytphosphonium bromide (443.4 g, 1 mol, prepared as described previously) is slurried with warm anhydrous dimethyl sulfoxide (50° C., 500 ml) and slowly added to the reaction mixture through the dropping funnel while keeping it at 25–30° C. The mixture is stirred for 30 minutes at room temperature at which time 2-heptanone (525.4 g, 1.1 mol) is slowly added through a dropping funnel. Reaction is slightly exothermic and cooling is needed to maintain 25–30° C. The mixture is stirred for 18 hr. and then poured into a 5L beaker containing 1L purified water with stirring. The oil phase (top) is allowed to separate out in a separatory funnel and the water phase is removed. The water phase is washed with hexanes (500 ml) and the organic phase is separated and combined with the oil phase from the water wash. The organic mixture is then extracted with water 3 times (500 ml each) followed by vacuum distillation to collect the clear, oily product at 140° C. and 1 mm Hg.

Hydrogenation of 7-methyldodecene-1-ol

Into a 3L rocking autoclave liner is added 7-methyldodecene-1-ol (100.6 g, 0.508 mol), methanol (300 ml) and platinum on carbon (10% by weight, 35 g). The mixture is hydrogenated at 180° C. under 1200 psig of hydrogen for 13 hrs., cooled and vacuum filtered through Celite 545 with washing of the Celite 545, suitably with methylene chloride. If needed, the filtration can be repeated to eliminate traces of Pt catalyst, and magnesium sulfate can be used to dry the product. The solution of product is concentrated on a rotary evaporator to obtain a clear oil.

Sulfation of 7-methyldodecanol

Into a dried 1L 3 neck round bottom flask fitted with a nitrogen inlet, dropping funnel, thermometer, mechanical stirring and nitrogen outlet is added chloroform (300 ml) and 7-methyldodecanol (100 g, 0.5 mol). Chlorosulfonic acid (60 g, 0.509 mol) is slowly added to the stirred mixture while maintaining 25–30° C. temperature with a ice bath. Once HCl evolution has stopped (1 hr.) slowly add sodium methoxide (25% in methanol) while keeping temperature at 25–30° C. until an aliquot at 5% concentration in water maintains a pH of 10.5. To the mixture is added hot ethanol (55° C., 2L). The mixture is vacuum filtered immediately. The filtrate is concentrated to a slurry on a rotary evaporator, cooled and then poured into 2L of ethyl ether. The mixture is chilled to 5° C., at which point crystallization occurs, and vacuum filtered. The crystals are dried in a vacuum oven at 50° C. for 3 hrs. to obtain a white solid (119 g, 92% active by cat SO3 titration).

EXAMPLE V

Synthesis of sodium 7-methyltridecyl sulfate
Sulfation of 7-methyltridecanol

Into a dried 1L 3 neck round bottom flask fitted with a nitrogen inlet, dropping funnel, thermometer, mechanical stirring and nitrogen outlet is added chloroform (300 ml) and 7-methyltridecanol (107 g, 0.5 mol), prepared as an intermediate in Example I. Chlorosulfonic acid (61.3 g, 0.52 mol) is slowly added to the stirred mixture while maintaining 25–30° C. temperature with an ice bath. Once HCI evolution has stopped (1 hr.) slowly add sodium methoxide (25% in methanol) while keeping temperature at 25–30° C. until a aliquot at 5% concentration in water maintains a pH of 10.5. To the mixture is added methanol (1L) and 300 ml of 1-butanol. Vacuum filter off the inorganic salt precipitate and remove methanol from the filtrate on a rotary evaporator. Cool to room temperature, add 1L of ethyl ether and let stand for 1 hour. The precipitate is collected by vacuum filtration. The product is dried in a vacuum oven at 50° C. for 3 hrs. to obtain a white solid (76 g, 90% active by cat SO3 titration).

EXAMPLE VI

Synthesis of sodium 7-methyldodecyl ethoxylated (E5) Alkoxylation of 7-methyldodecanol Into a dried 1L 3 neck round bottom flask fitted with a nitrogen inlet, mechanical stirrer, and a y-tube fitted with a thermometer and a gas outlet is added 7-methyldodecanol, synthesized as described in Example IV. For purposes of removing trace amounts of moisture, the alcohol is sparged with nitrogen for about 30 minutes at 80–100° C. Continuing with a nitrogen sweep, sodium metal is added as the catalyst and allowed to melt with stirring at 120–140° C. With vigorous stirring, ethylene oxide gas is added in 140 minutes while keeping the reaction temperature at 120–140° C. After the correct weight (equal to five equivalents of ethylene oxide) has been added, nitrogen is swept through the apparatus for 20–30 minutes as the sample is allowed to cool. The desired 7-methyldodecyl ethoxylate (average of 5 ethoxylates per molecule) product is then collected.

EXAMPLE VII

Preparation of mid-chain branched C13 sodium alcohol sulfate, alcohol ethoxylate, and sodium alcohol ethoxy (E1) sulfate from experimental Shell Research alcohol samples Shell Research experimental test C13 alcohol samples are used to make alcohol sulfates, alcohol ethoxylates, and alcohol ethoxy sulfates. These experimental alcohols are ethoxylated and/or sulfated according to the following procedures. The experimental alcohols are made from C12 alpha olefins in this case. The C12 alpha olefins are skeletally rearranged to produce branched chain olefins. The skeletal rearrangement produces a limited number of branches, preferably mid-chain. The rearrangement produces C1–C3 branches, more preferably ethyl, most preferably methyl. The branched chain olefin mixture is subjected to catalytic hydroformylation to produce the desired branched chain alcohol mixture.

Sulfation of Shell $C_{13}$ Experimental Alcohol

Into a dried 100 ml 3 neck round bottom flask fitted with a gas inlet, dropping funnel, mechanical stirrer, and a y-tube fitted with a thermometer and a gas outlet is added Shell C13 Experimental Alcohol (14.0 g, 0.07 mol) and diethyl ether (20 ml). Chlorosulfonic acid (8.6 g, 0.07 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCl. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (16.8 g, 0.8 mol) and methanol (50 ml) that is cooled in an ice water bath. After pH >12 is confirmed the solution is allowed to stir about 30 minutes then poured into a stainless pan. Most of the solvent is allowed to evaporate overnight in the fume hood. The next morning the sample is transferred to a glass dish and placed in a vacuum drying oven. The sample is allowed to dry all day and overnight at 40–60° C. with 25–30 inches Hg vacuum. After bottling 21 g of ivory tacky solid, the cat SO3 analysis shows the sample is about 86% active. The pH of the sample is about 11.5.

Ethoxylation of Shell C13 Experimental Alcohol to E1

Into a dried 250 ml 3 neck round bottom flask fitted with a gas inlet, mechanical stirrer, and a y-tube fitted with a thermometer and a gas outlet is added Shell C13 Experimental Alcohol (50.0 g, 0.25 mol). For the purpose of removing trace amounts of moisture, the alcohol is sparged with nitrogen for about 30 minutes at 60–80° C. Continuing with a nitrogen sweep, sodium metal (0.3 g, 0.01 mol) is added as the catalyst and allowed to melt with stirring at 120–140° C. With vigorous stirring, ethylene oxide gas (11.0 g, 0.25 mol) is added in 35 minutes while keeping the reaction temperature 120–140° C. After the correct weight of ethylene oxide is added, nitrogen is swept through the apparatus for 20–30 minutes as the sample is allowed to cool. The yellow liquid product (59.4 g, 0.24 mol) is bottled under nitrogen.

Sulfation of Shell $C_{13}$ Extperimental Alcohol Ethoxylate (E1)

Into a dried 250 ml 3 neck round bottom flask fitted with a gas inlet, dropping funnel, mechanical stirrer, and a y-tube fitted with a thermometer and a gas outlet is added Shell $C_{13}$ Experimental Ethoxylate (E1) (48.8 g, 0.20 mol) and diethyl ether (50 ml). Chlorosulfonic acid (24.5 g, 0.21 mol) is slowly added to the stirred mixture while maintaining a reaction temperature of 5–15° C. with an ice water bath. After the chlorosulfonic acid is added a slow nitrogen sweep and a vacuum (10–15 inches Hg) is begun to remove HCl. Also the reaction is warmed to 30–40° C. with the addition of a warm water bath. After about 45 minutes the vacuum in increased to 25–30 inches Hg and maintained for an additional 45 minutes. The acidic reaction mixture is slowly poured into a vigorously stirred beaker of 25% sodium methoxide (48.8 g, 0.23 mol) and methanol (100 ml) that is cooled in an ice water bath. After pH >12 is confirmed the solution is allowed to stir about 30 minutes then poured into a stainless pan. Most of the solvent is allowed to evaporate overnight in the flime hood. The next morning the sample is transferred to a glass dish and placed in a vacuum drying oven. The sample is allowed to dry all day and overnight at 40–60° C. with 25–30 inches Hg vacuum. After bottling 64.3 g of ivory tacky solid, the cat SO3 analysis shows the sample is about 92% active. The pH of the sample is about 10.8.

EXAMPLE VIII

Light-duty liquid dishwashing detergent compositions comprising the mid-chain branched surfactants of the present claims are prepared:

TABLE VIII

| Ingredient | Wt. % A | Wt. % B | Wt. % C | Wt. % D |
|---|---|---|---|---|
| Sodium Mid-Branched C12–15 alkyl ethoxy (0.6) sulfate | 5 | 10 | 20 | 30 |
| Mid-Branched C12–13 alkyl ethoxylate (9 moles EO) | 1 | 1 | 1 | 1 |
| Sodium $C_{12-13}$ alkyl ethoxy (1–3) sulfate | 25 | 20 | 10 | 0 |
| $C_{12-14}$ Glucose Amide | 4 | 4 | 4 | 4 |
| Coconut amine oxide | 4 | 4 | 4 | 4 |
| EO/PO Block Co-polymer-Tetronic ® 704 | 0.5 | 0.5 | 0.5 | 0.5 |
| Ethanol | 6 | 6 | 6 | 6 |
| Calcium xylene sulfonate | 5 | 5 | 5 | 5 |
| Magnesium$^{++}$ (added as chloride) | 3.0 | 3.0 | 3.0 | 3.0 |
| Water, thickeners and minors | to 100% | to 100% | to 100% | to 100% |
| pH @ 10% (as made) | 7.5 | 7.5 | 7.5 | 7.5 |

EXAMPLE IX

The following liquid detergent compositions are made:

TABLE IX

| | A | B | C |
|---|---|---|---|
| pH 10% | 9 | 10 | 10 |
| Mid-branched Alcohol ethoxy (0.6) Sulfate | 0 | 28 | 25 |
| Mid-branched Alcohol ethoxy (1) Sulfate | 30 | 0 | 0 |
| Amine Oxide (C12–14) | 5 | 3 | 7 |
| Betaine | 3 | 0 | 1 |
| Polyhydroxy fatty acid amide (C14) | 0 | 1.5 | 0 |
| AE nonionic | 2 | 0 | 4 |
| Diamine | 1 | 5 | 7 |
| $Mg^{++}$ (as MgCl2) | 0.25 | 0 | 0 |
| Citrate (cit2K3) | 0.25 | 0 | 0 |
| Total (perfumes, dye, water, ethanol, etc.) | (to 100%) | | |

| | D | E | F |
|---|---|---|---|
| pH 10% | 9.3 | 8.5 | 11 |
| Mid-Branched alcohol ethoxy (0.6) Sulfate | 10 | 15 | 10 |
| Paraffin Sulfonate | 10 | 0 | 0 |
| Linear Alkyl Benzene Sulfonate | 5 | 15 | 12 |
| Betaine | 3 | 1 | 0 |
| Polyhydroxy fatty acid amide (C12) | 3 | 0 | 1 |
| AE nonionic | 0 | 0 | 20 |
| DTPA | 0 | 0.2 | 0 |
| Citrate (as Cit2K3) | 0.7 | 0 | 0 |
| Diamine | 1 | 5 | 7 |
| Mg++ (as MgCl2) | 1 | 0 | 0 |
| Ca++ (as CaXS)2) | 0 | 0.5 | 0 |
| Protease | 0.01 | 0 | 0.05 |
| Amylase | 0 | 0.05 | 0.05 |
| Hydrotrope | 2 | 1.5 | 3 |
| Total perfumes, dye, water, ethanol, etc.) | (to 100%) | | |

The diamine is selected from: dimethyl aminopropyl amine; 1,6-hexane diamine; 1,3 propane diamine; 2-methyl 1,5 pentane diamine; 1,3-pentanediamine; 1-methyl-diaminopropane.

The amylase is selected from: Termamyl®, Fungamyl®; Duramyl®; BAN®; and α amylase enzymes described in WO95/26397 and in co-pending application by Novo Nordisk PCT/DK96/00056.

The lipase is selected from: Amano-P; M1 Lipase®; Lipomax®; Lipolase®; D96L-lipolytic enzyme variant of the native lipase derived from Humicola lanuginosa as described in U.S. Ser. No. 08/341,826; and the Humicola lanuginosa strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®; and Optimase®; and Alcalase®.

Hydrotropes are selected from sodium, potassium, ammonium or water-soluble substituted ammonium salts of toluene sulfonic acid, naphthalene sulfonic acid, cumene sulfonic acid, xylene sulfonic acid.

DTPA is diethylenetriaminepentaacetate chelant.

EXAMPLE X

TABLE X

| | A | B | C | D |
|---|---|---|---|---|
| pH 10% | 8.5 | 9 | 9.0 | 9.0 |
| Mid-branched alcohol ethoxy (0.6) Sulfate | 0 | 0 | 0 | 15 |
| Mid-branched alcohol ethoxy (1) Sulfate | 0 | 30 | 0 | 0 |
| Mid-branched alcohol ethoxy (1.4) Sulfate | 30 | 0 | 27 | 0 |
| Mid-branched alcohol ethoxy (2.2) Sulfate | 0 | 0 | 0 | 15 |
| Amine Oxide | 5 | 5 | 5 | 3 |
| Betaine | 3 | 3 | 0 | 0 |
| AE nonionic | 2 | 2 | 2 | 2 |
| Diamine | 1 | 2 | 4 | 2 |
| Mg++ (as MgC12) | 0.25 | 0.25 | 0 | 0 |
| Ca++ (as CaXS)2) | 0 | 0.4 | 0 | 0 |
| Total perfumes, dye, water, ethanol, etc.) | (to 100%) | | | |

| | E | F | G | H | I | J |
|---|---|---|---|---|---|---|
| pH 10% | 9.3 | 8.5 | 11 | 10 | 9 | 9.2 |
| Mid-branched alcohol ethoxy (0.6) Sulfate | 10 | 15 | 10 | 27 | 27 | 20 |
| Paraffin Sulfonate | 10 | 0 | 0 | 0 | 0 | 0 |
| Linear Alkyl Benzene Sulfonate | 5 | 15 | 12 | 0 | 0 | 0 |
| Betaine | 3 | 1 | 0 | 2 | 2 | 0 |
| Amine Oxide | 0 | 0 | 0 | 2 | 5 | 7 |
| Polyhydroxy fatty acid amide (C12) | 3 | 0 | 1 | 2 | 0 | 0 |
| AE nonionic | 0 | 0 | 20 | 1 | 0 | 2 |
| Hydrotrope | 0 | 0 | 0 | 0 | 0 | 5 |
| Diamine | 1 | 5 | 7 | 2 | 2 | 5 |
| Mg++ (as MgCl2) | 1 | 0 | 0 | .3 | 0 | 0 |
| Ca++ (as CaXS)2) | 0 | 0.5 | 0 | 0 | 0.1 | 0.1 |
| Protease | 0.1 | 0 | 0 | 0.05 | 0.06 | 0.1 |
| Amylase | 0 | 0.07 | 0 | 0.1 | 0 | 0.05 |
| Lipase | 0 | 0 | 0.025 | 0 | 0.05 | 0.05 |
| DTPA | 0 | 0.3 | 0 | 0 | 0.1 | 0.1 |
| Citrate (Cit2K3) | 0.65 | 0 | 0 | 0.3 | 0 | 0 |
| Total perfumes, dye, water, ethanol, etc.) | (to 100%) | | | | | |

The diamine is selected from: dimethyl aminopropyl amine; 1,6-hexane diamnine; 1,3 propane diamine; 2-methyl 1,5 pentane diamine; 1,3-Pentanediamine; 1-methyl-diaminopropane.

The amylase is selected from: Termamyl®, Fungamyl®; Duramyl®; BAN®; and α amylase enzymes described in WO95/26397 and in co-pending application by Novo Nordisk PCT/DK96/00056.

The lipase is selected from: Amano-P; M1 Lipase®; Lipomax®; Lipolase®; D96L-lipolytic enzyme variant of the native lipase derived from Humicola lanuginosa as described in U.S. Ser. No. 08/341,826; and the Humicola lanuginosa strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®; and Optimase®; and Alcalase ®.

Hydrotropes are selected from sodium, potassium, amnmonium or water-soluble substituted ammonium salts of toluene sulfonic acid, naphthalene sulfonic acid, cumene sulfonic acid, xylene sulfonic acid.

DTPA is diethylenetriaminepentaacetate chelant.

EXAMPLE XI

TABLE XI

| | A | B | C | D | E |
|---|---|---|---|---|---|
| pH 10% | 8.5 | 9 | 10 | 10 | 10 |
| Mid-branched alcohol ethoxy (0.6) Sulfate | 0 | 0 | 0 | 15 | 0 |
| Mid-branched alcohol ethoxy (1) Sulfate | 0 | 30 | 0 | 0 | 33 |
| Mid-branched alcohol ethoxy (1.4) Sulfate | 30 | 0 | 27 | 0 | 0 |
| Mid-branched alcohol ethoxy (2.2) Sulfate | 0 | 0 | 0 | 15 | 0 |
| Amine Oxide | 5 | 5 | 5 | 3 | 6 |
| Betaine | 3 | 3 | 0 | 0 | 0 |
| AE nonionic | 2 | 2 | 2 | 2 | 4 |
| Diamine | 1 | 2 | 4 | 4 | 5 |
| K Citrate | 0.25 | 0.5 | 0 | 3.5 | 2 |
| Maleic Acid | 0.5 | 1 | 3 | 0 | 2 |
| Mg++ (as MgCl2) | 0.25 | 0.25 | 0 | 0 | 0 |
| Ca++ (as Ca(XS)2) | 0 | 0.4 | 0 | 0 | 0 |
| Total (perfumes, dye, water, ethanol, etc.) | (to 100%) | | | | |

The diamine is selected from: dimethyl aminopropyl amine; 1,6-hexane diamine; 1,3 propane diamine; 2-methyl 1,5 pentane diamine; 1,3-Pentanediamine; 1-methyl-diaminopropane.

The amylase is selected from: Termamyl®, Fungamyl®; Duramyl®; BAN®; and α amylase enzymes described in WO95/26397 and in co-pending application by Novo Nordisk PCT/DK96/00056.

The lipase is selected from: Amano-P; M1 Lipase®; Lipomax®; Lipolase®; D96L-lipolytic enzyme variant of the native lipase derived from Humicola lanuginosa as described in U.S. Ser. No. 08/341,826; and the Humicola lanuginosa strain DSM 4106.

The protease is selected from: Savinase®; Maxatase®; Maxacal®; Maxapem 15®; subtilisin BPN and BPN'; Protease B; Protease A; Protease D; Primase®; Durazym®; Opticlean®; and Optimase®; and Alcalase®.

Hydrotropes are selected from sodium, potassium, ammonium or water-soluble substituted ammonium salts of toluene sulfonic acid, naphthalene sulfonic acid, cumene sulfonic acid, xylene sulfonic acid.

DTPA is diethylenetriaminepentaacetate chelant.

What is claimed is:

1. An aqueous light duty liquid dishwashing detergent composition comprising:

from 5% to 70% by weight of a surfactant system which comprises at least 10%, by weight of a branched surfactant mixture, said branched surfactant mixture comprising mid-chain branched and linear surfactant compounds, said linear compounds comprising less than 25%, by weight of the branched surfactant mixture and said mid-chain branched compounds being of the formula:

$$A^b\text{–}B$$

wherein:

$A^b$ is a hydrophobic C9 to C18, total carbons in the moiety, mid-chain branched alkyl moiety having: (1) a longest linear carbon chain attached to the—B moiety in the range of from 8 to 17 carbon atoms; (2) one or more $C_1$–$C_3$ alkyl moieties branching from this longest linear carbon chain; (3) at least one of the branching alkyl moieties is attached directly to a carbon of the longest linear carbon chain at a position within the range of position 3 carbon, counting from carbon #1 which is attached to the—B moiety, to position ω−2 carbons the terminal carbon minus 2 carbons; and (4) the surfactant composition has an average total number of carbon atoms in the $A^b$ moiety in the above formula within the range of greater than 12 to 14.5; and B is a hydrophilic moiety selected from the group consisting of $OSO_3M$, $(EO/PO)mOSO_3M$, (EO/PO)mOH and mixtures thereof, wherein EO/PO are alkoxy moieties selected from the group consisting of ethoxy, propoxy, and mixtures thereof, and in is at least 0.01 to 30; and from 1% to 10% by weight of a suds booster/stabilizer selected from the group consisting of betaine surfactants, alkanol fatty acid amides, amine oxide semi-polar nonionic surfactants, $C_8$–$C_{22}$ alkylpolyglycosides, and combinations thereof.

2. The liquid detergent composition according to claim 1, further comprising from 1% to 10% by weight of a nonionic surfactant component which comprises surfactants selected from the group consisting of $C_8$–$C_{18}$ polyhydroxy fatty acid amides, $C_8$–$C_{18}$ alcohol ethoxylates and combinations thereof.

3. The liquid detergent composition according to claim 1, further comprising from 0.2% to 0.8% by weight of a polymeric surfactant characterized by ethylene oxide and propylene oxide condensed with ethylene diamino to form a block co-polymer having a molecular weight of from 4000 to 6000 and an HLB of from 10 to 20.

4. The liquid detergent composition according to claim 1, further comprising a detersive amount of enzymes.

5. The liquid detergent composition according to claim 1, further comprising an effective amount of low molecular weight organic diamine having a pK1 and a pK2, wherein both pK1 and pK2 are in the range of from 8.0 to 11.5, wherein the detergent composition has a pH of from 8.0 to 12 as measured as a 10% aqueous solution.

6. A hand dishwashing detergent composition according to claim 5, wherein said diamine is selected from the group consisting of:

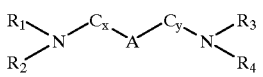

wherein $R^1$ through $R_4$ are each independently selected from H, methyl, ethyl, and ethylene oxides; Cx and Cy are each independently selected from methylene groups or branched alkyl groups, where x+y is from 3 to 6; and A is optionally present and if present is selected from electron donating or withdrawing moieties; provided that if A is present, then both x and y are greater than or equal to 2.

7. A hand dishwashing detergent composition according to claim 6 wherein said diamine is selected from the group consisting of:

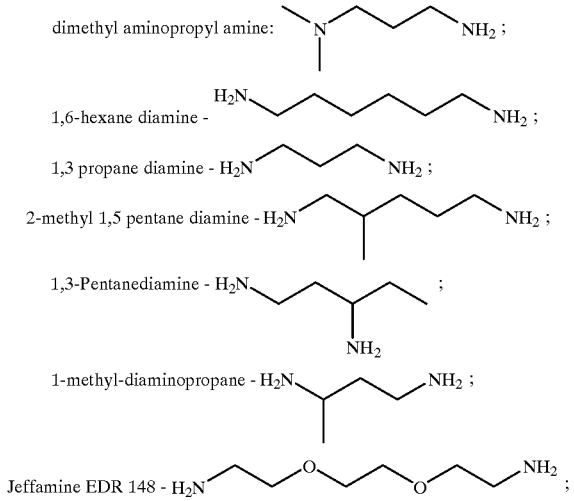

and mixtures thereof.

8. The liquid detergent composition according to claim 1, wherein the ratio of mid-chain branched alkyl sulfate and alkyl ethoxy sulfate to conventional alkyl sulfate and alkyl ethoxy sulfate is greater than about 1:1.

9. A method of using the liquid detergent composition according to claim 1, comprising the step of diluting the liquid detergent composition with water.

10. A method of using the liquid detergent composition according to claim 1, comprising the step of applying the liquid detergent directly to a sponge or a washcloth.

11. The liquid detergent composition according to claim 1, further comprising from about 0.1 to about 8% of an alkyl dimethyl amine oxide and from about 0.05 to about 2% of Magnesium ions.

12. The liquid detergent composition according to claim 1, further comprising from about 0.1 to about 8% of an alkyl dimethyl amine oxide and from about 0.05 to about 2% of Calcium ions.

13. The liquid detergent composition according to claim 1, further comprising from about 30% to about 95% by weight of an aqueous liquid carrier.

14. The liquid detergent composition according to claim 13, wherein the aqueous liquid carrier further comprises from about 0.5% to 8% by weight of the liquid detergent composition of a hydrotrope selected from alkali metal and calcium xylene and toluene sulfonates and from about 0.5% to 8% by weight of the liquid detergent composition of a solvent selected from $C_1$–$C_4$ alkanols.

15. A process for making the liquid detergent composition according to claim 11, wherein the aqueous liquid carrier comprises water having a hardness of at least about 6 gpg.

16. The liquid detergent composition according to claim 1, wherein the detergent composition comprises only one phase at temperatures greater than about 10° C.

17. The liquid detergent composition according to claim 1, further comprising an α-amylases having a specific activity at least 25% higher than the specific activity of Termamyl® at a temperature range of 25° C. to 55° C. and at a pH value in the range of 8 to 10, measured by the Phadebas® α-amylase activity assay.

18. The liquid detergent composition according to claim 17, wherein the α-amylase is obtained from an alkalophilic *Bacillus species*, and comprises the following amino sequence in the N-terminal His-His-Asn-Gly-Thr-Asn-Gly-Thr-Met-Met-Gin-Tyr-Phe-Glu-Trp-Tyr-Leu-Pro-Asn-Asp.

19. An aqueous light duty liquid dishwashing detergent composition comprising:

from 5% to 70% by weight of a surfactant system which comprises at least 10%, by weight of a branched surfactant mixture, said branched surfactant mixture comprising mid-chain branched and linear surfactant compounds, said linear compounds comprising less than 25%, by weight of the branched surfactant mixture and said mid-chain branched compounds being of the formula:

$$A^b\text{–}B$$

wherein the $A^b$ moiety of the mid-chain branched surfactant is a branched alkyl moiety having the formula:

$$CH_3CH_2(CH_2)_w\overset{\overset{\displaystyle R}{|}}{C}H(CH_2)_x\overset{\overset{\displaystyle R^1}{|}}{C}H(CH_2)_y\overset{\overset{\displaystyle R^2}{|}}{C}H(CH_2)_zCH_2,$$

wherein the total number of carbon atoms in the branched alkyl moiety, including the R, $R^1$, and $R^2$ branching, is from 10 to 17; R, $R^1$, and $R^2$ are each independently selected from hydrogen and $C_1$–$C_3$ alkyl, w is an integer from 0 to 10; x is an integer from 1 to 10; y is an integer from 1 to 10; z is an integer from 0 to 10; and w+x+y+z is from 3 to 10; provided that R, $R^1$, and $R^2$ are not all hydrogen, and wherein when z is 0, at least R or $R^1$ is not hydrogen; and the surfactant composition has an average total number of carbon atoms in the $A^b$ moiety in the above formula within the range of greater than 12 to 14.5; and B is a hydrophilic moiety selected from the group consisting of $OSO_3M$, $(EO/PO)mOSO_3M$, (EO/PO)mOH and mixtures thereof, wherein EO/PO are alkoxy moieties selected from the group consisting of ethoxy, propoxy, and mixtures thereof, and m is at least 0.01 to 30.

20. An aqueous light duty liquid dishwashing detergent composition comprising:

from 5% to 70% by weight of a surfactant system which comprises at least 10%, by weight of a branched surfactant mixture, said branched surfactant mixture comprising mid-chain branched and linear surfactant compounds, said linear compounds comprising less than 25%, by weight of the branched surfactant mixture and said mid-chain branched compounds being of the formula:

$$A^b\text{–}B$$

wherein the $A^b$ moiety of the mid-chain branched surfactant compound is a branched alkyl moiety having a formula selected from the group consisting of:

$$CH_3(CH_2)_a\overset{\overset{\displaystyle CH_3}{|}}{C}H(CH_2)_bCH_2\text{—}, \quad \text{(I)}$$

$$CH_3(CH_2)_d\overset{\overset{\displaystyle CH_3}{|}}{C}H(CH_2)_e\overset{\overset{\displaystyle CH_3}{|}}{C}HCH_2\text{—}, \quad \text{(II)}$$

and mixtures thereof;

wherein, a, b, d, and e are integers, a+b is from 6 to 13, d+e is from 4 to 11; and wherein, when a+b=6, a is an integer from 2 to 5 and b is an integer from 1 to 4;

when a+b=7, a is an integer from 2 to 6 and b is an integer from 1 to 5;

when a+b=8, a is an integer from 2 to 7 and b is an integer from 1 to 6;

when a+b=9, a is an integer from 2 to 8 and b is an integer from 1 to 7;

when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when d+e=4, d is an integer from 2 to 3 and e is an integer from 1 to 2;

when d+e=5, d is an integer from 2 to 4 and c is an integer from 1 to 3;

when d+e=6, d is an integer from 2 to 5 and e is an integer from 1 to 4;

when d+e=7, d is an integer from 2 to 6 and e is an integer from 1 to 5;

when d+e=8, d is an integer from 2 to 7 and e is an integer from 1 to 6;

when d+e=9, d is an integer from 2 to 8 and e is an integer from 1 to 7;

when d+e=10, d is an integer from 2 to 9 and e is an integer from 1 to 8;

when d+e=11, d is an integer from 2 to 10 and e is an integer from 1 to 9;

and the surfactant composition has an average total number of carbon atoms in the $A^b$ moiety in the above formula within the range of greater than 12 to 14.5; and B is a hydrophilic moiety selected from the group consisting of $OSO_3M$, $(EO/PO)mOSO_3M$, (EO/PO)mOH and mixtures thereof, wherein EO/PO are alkoxy moieties selected from the group consisting of ethoxy, propoxy, and mixtures thereof, and m is at least 0.01 to 30.

* * * * *